US008249883B2

(12) United States Patent
Mehrotra et al.

(10) Patent No.: US 8,249,883 B2
(45) Date of Patent: Aug. 21, 2012

(54) CHANNEL EXTENSION CODING FOR MULTI-CHANNEL SOURCE

(75) Inventors: Sanjeev Mehrotra, Kirkland, WA (US); Kishore Kotteri, Bothell, WA (US)

(73) Assignee: Microsoft Corporation, Redmond, WA (US)

( * ) Notice: Subject to any disclaimer, the term of this patent is extended or adjusted under 35 U.S.C. 154(b) by 1007 days.

(21) Appl. No.: 11/925,733

(22) Filed: Oct. 26, 2007

(65) Prior Publication Data

US 2009/0112606 A1 Apr. 30, 2009

(51) Int. Cl.
*G10L 19/00* (2006.01)

(52) U.S. Cl. ..... 704/501; 704/200; 704/205; 704/219; 704/226; 704/229; 704/500; 704/273; 704/246; 704/233; 704/230; 341/155; 345/424; 375/141; 375/148; 375/240; 381/310; 381/63; 455/63; 455/72

(58) Field of Classification Search ..... 704/205, 704/226, 233, 200.1, 219, 229, 230, 246, 704/273, 500, 501; 341/155; 345/424; 375/141, 375/148, 240, 240.1, 240.12; 381/310, 63; 455/63.1, 72

See application file for complete search history.

(56) References Cited

U.S. PATENT DOCUMENTS

| | | | |
|---|---|---|---|
| 3,684,838 | A | 8/1972 | Kahn |
| 4,538,234 | A | 8/1985 | Honda et al. |
| 4,713,776 | A | 12/1987 | Araseki |
| 4,776,014 | A | 10/1988 | Zinser |
| 4,922,537 | A | 5/1990 | Frederiksen |
| 4,949,383 | A | 8/1990 | Koh et al. |
| 5,040,217 | A | 8/1991 | Brandenburg et al. |
| 5,079,547 | A | 1/1992 | Fuchigama et al. |
| 5,115,240 | A | 5/1992 | Fujiwara et al. |
| 5,142,656 | A | 8/1992 | Fielder et al. |
| 5,185,800 | A | 2/1993 | Mahieux |
| 5,199,078 | A | 3/1993 | Orglmeister |
| 5,222,189 | A | 6/1993 | Fielder |
| 5,260,980 | A | 11/1993 | Akagiri et al. |
| 5,285,498 | A | 2/1994 | Johnston |
| 5,295,203 | A | 3/1994 | Krause et al. |
| 5,297,236 | A | 3/1994 | Antill et al. |
| 5,357,594 | A | 10/1994 | Fielder |
| 5,369,724 | A | 11/1994 | Lim |
| 5,388,181 | A | 2/1995 | Anderson et al. |
| 5,394,473 | A | 2/1995 | Davidson |
| 5,438,643 | A | 8/1995 | Akagiri et al. |

(Continued)

FOREIGN PATENT DOCUMENTS

EP 0610975 A3 8/1994

(Continued)

OTHER PUBLICATIONS

Search Report from PCT/US04/24935, dated Feb. 24, 2005.

(Continued)

*Primary Examiner* — Richemond Dorvil
*Assistant Examiner* — Michael Colucci
(74) *Attorney, Agent, or Firm* — Klarquist Sparkman, LLP

(57) ABSTRACT

A multi-channel audio decoder reconstructs multi-channel audio of more than two physical channels from a reduced set of coded channels based on correlation parameters that specify a full power cross-correlation matrix of the physical channels, or merely preserve a partial correlation matrix (such as power of the physical channels, and some subset of cross-correlations between the physical channels, or cross-correlations of the physical channels with coded or virtual channels).

20 Claims, 17 Drawing Sheets

U.S. PATENT DOCUMENTS 5,455,874 A 10/1995 Ormsby et al.
5,471,558 A 11/1995 Tsutsui
5,479,562 A 12/1995 Fielder et al.
5,491,754 A 2/1996 Jot et al.
5,539,829 A 7/1996 Lokhoff et al.
5,559,900 A 9/1996 Jayant et al.
5,574,824 A * 11/1996 Slyh et al. ..... 704/226
5,581,653 A 12/1996 Todd
5,627,938 A 5/1997 Johnston
5,640,486 A 6/1997 Lim
5,654,702 A 8/1997 Ran
5,661,755 A 8/1997 Van De Kerkhof et al.
5,682,461 A 10/1997 Silzle et al.
5,686,964 A 11/1997 Tabatabai et al.
5,737,720 A 4/1998 Miyamori et al.
5,752,225 A 5/1998 Fielder
5,777,678 A 7/1998 Ogata et al.
5,812,971 A 9/1998 Herre
5,819,214 A 10/1998 Suzuki et al.
5,842,160 A 11/1998 Zinser
5,845,243 A 12/1998 Smart et al.
5,852,806 A 12/1998 Johnston et al.
5,870,480 A 2/1999 Griesinger
5,886,276 A 3/1999 Levine et al.
5,956,674 A 9/1999 Smyth et al.
5,974,380 A 10/1999 Smyth et al.
5,995,151 A 11/1999 Naveen et al.
6,021,386 A 2/2000 Davis et al.
6,029,126 A 2/2000 Malvar
6,058,362 A 5/2000 Malvar
6,115,688 A 9/2000 Brandenburg et al.
6,115,689 A 9/2000 Malvar
6,122,607 A 9/2000 Ekudden et al.
6,182,034 B1 1/2001 Malvar
6,226,616 B1 5/2001 You et al.
6,230,124 B1 5/2001 Maeda
6,240,380 B1 5/2001 Malvar
6,266,003 B1 7/2001 Hoek
6,341,165 B1 1/2002 Gbur et al.
6,393,392 B1 5/2002 Minde
6,424,939 B1 7/2002 Herre et al.
6,449,596 B1 9/2002 Ejima
6,498,865 B1 12/2002 Brailean et al.
6,601,032 B1 7/2003 Surucu
6,680,972 B1 1/2004 Liljeryd
6,708,145 B1 3/2004 Liljeryd et al.
6,735,567 B2 5/2004 Gao et al.
6,760,698 B2 7/2004 Gao
6,766,293 B1 7/2004 Herre
6,771,723 B1 8/2004 Davis et al.
6,771,777 B1 8/2004 Gbur et al.
6,778,709 B1 8/2004 Taubman
6,804,643 B1 10/2004 Kiss
6,836,739 B2 12/2004 Sato
6,879,265 B2 4/2005 Sato
6,882,731 B2 4/2005 Irwan et al.
6,934,677 B2 8/2005 Chen et al.
6,999,512 B2 2/2006 Yoo et al.
7,003,467 B1 * 2/2006 Smith et al. ..... 704/500
7,010,041 B2 3/2006 Graziani et al.
7,043,423 B2 5/2006 Vinton et al.
7,062,445 B2 6/2006 Kadatch
7,107,211 B2 9/2006 Griesinger
7,146,315 B2 * 12/2006 Balan et al. ..... 704/233
7,174,135 B2 2/2007 Sluijter et al.
7,177,808 B2 2/2007 Yantorno et al.
7,193,538 B2 3/2007 Craven et al.
7,240,001 B2 7/2007 Chen et al.
7,310,598 B1 12/2007 Mikhael et al.
7,394,903 B2 * 7/2008 Herre et al. ..... 381/63
7,400,651 B2 7/2008 Sato
7,447,631 B2 11/2008 Truman et al.
7,460,990 B2 12/2008 Mehrotra et al.
7,536,021 B2 5/2009 Dickins et al.
7,548,852 B2 6/2009 Den Brinker et al.
7,562,021 B2 7/2009 Mehrotra et al.
7,630,882 B2 12/2009 Mehrotra et al.
7,647,222 B2 1/2010 Dimkovic et al.
7,689,427 B2 3/2010 Vasilache
7,761,290 B2 7/2010 Koishida et al.
7,885,819 B2 2/2011 Koishida et al.
8,046,214 B2 10/2011 Mehrotra et al.
2001/0017941 A1 8/2001 Chaddha
2002/0051482 A1 5/2002 Lomp
2002/0135577 A1 9/2002 Kase et al.
2003/0093271 A1 5/2003 Tsushima et al.
2003/0115041 A1 * 6/2003 Chen et al. ..... 704/200.1
2003/0115042 A1 6/2003 Chen et al.
2003/0115050 A1 6/2003 Chen et al.
2003/0115051 A1 6/2003 Chen et al.
2003/0115052 A1 6/2003 Chen et al.
2003/0187634 A1 10/2003 Li
2003/0193900 A1 10/2003 Zhang et al.
2003/0233234 A1 12/2003 Truman et al.
2003/0233236 A1 12/2003 Davidson et al.
2003/0236072 A1 * 12/2003 Thomson ..... 455/63.1
2003/0236580 A1 12/2003 Wilson et al.
2004/0044527 A1 3/2004 Thumpudi et al.
2004/0049379 A1 * 3/2004 Thumpudi et al. ..... 704/205
2004/0059581 A1 3/2004 Kirovski et al.
2004/0068399 A1 4/2004 Ding
2004/0101048 A1 5/2004 Paris
2004/0114687 A1 6/2004 Ferris et al.
2004/0133423 A1 7/2004 Crockett
2004/0165737 A1 8/2004 Monro
2004/0243397 A1 12/2004 Averty et al.
2004/0267543 A1 12/2004 Ojanpera
2005/0021328 A1 1/2005 Van De Kerkhof et al.
2005/0065780 A1 3/2005 Wiser et al.
2005/0074127 A1 4/2005 Herre et al.
2005/0108007 A1 5/2005 Bessette et al.
2005/0149322 A1 7/2005 Bruhn et al.
2005/0159941 A1 7/2005 Kolesnik et al.
2005/0165611 A1 7/2005 Mehrotra et al.
2005/0195981 A1 9/2005 Faller et al.
2006/0002547 A1 1/2006 Stokes et al.
2006/0004566 A1 1/2006 Oh et al.
2006/0025991 A1 2/2006 Kim
2006/0074642 A1 4/2006 You
2006/0095269 A1 5/2006 Smith et al.
2006/0106597 A1 5/2006 Stein
2006/0126705 A1 6/2006 Bachl et al.
2006/0140412 A1 6/2006 Villemoes et al.
2007/0016406 A1 1/2007 Thumpudi et al.
2007/0016415 A1 1/2007 Thumpudi et al.
2007/0016427 A1 1/2007 Thumpudi et al.
2007/0036360 A1 2/2007 Breebaart
2007/0063877 A1 3/2007 Shmunk et al.
2007/0071116 A1 3/2007 Oshikiri
2007/0094027 A1 4/2007 Vasilache
2007/0127733 A1 6/2007 Henn et al.
2007/0172071 A1 7/2007 Mehrotra et al.
2007/0174062 A1 * 7/2007 Mehrotra et al. ..... 704/500
2007/0174063 A1 * 7/2007 Mehrotra et al. ..... 704/501
2007/0269063 A1 11/2007 Goodwin et al.
2008/0027711 A1 1/2008 Rajendran et al.
2008/0052068 A1 2/2008 Aguilar et al.
2008/0312758 A1 12/2008 Koishida et al.
2008/0312759 A1 12/2008 Koishida et al.
2008/0319739 A1 12/2008 Mehrotra et al.
2009/0006103 A1 1/2009 Koishida et al.
2009/0083046 A1 3/2009 Mehrotra et al.
2009/0112606 A1 4/2009 Mehrotra et al.
2011/0196684 A1 8/2011 Koishida et al.

FOREIGN PATENT DOCUMENTS

EP 0663740 7/1995
EP 0910927 4/1999
EP 0931386 7/1999
EP 1175030 1/2002
EP 1396841 3/2004
EP 1783745 A1 5/2007
JP 06-118995 4/1994
JP Hei 8-248997 9/1996
JP Hei 9-101798 4/1997
JP 2000-515266 11/2000
JP 2001-521648 11/2001

| | | | |
|---|---|---|---|
| JP | 2001-356788 | | 12/2001 |
| JP | 2002-041089 | | 2/2002 |
| JP | 2002-073096 | | 3/2002 |
| JP | 2002-132298 | | 5/2002 |
| JP | 2002-175092 | | 6/2002 |
| JP | 2005-173607 | | 6/2005 |
| WO | WO 90/09022 | | 8/1990 |
| WO | WO 90/09064 | | 8/1990 |
| WO | WO 91/16769 | | 10/1991 |
| WO | WO 98/57436 | A2 | 12/1998 |
| WO | WO 99/04505 | | 1/1999 |
| WO | WO 99/04505 | A1 | 1/1999 |
| WO | WO 01/97212 | | 12/2001 |
| WO | WO 02/43054 | | 5/2002 |
| WO | WO 03/003345 | A1 | 1/2003 |
| WO | WO 2005/040749 | A1 | 5/2005 |
| WO | WO 2007/011749 | | 1/2007 |

OTHER PUBLICATIONS

Search Report from PCT/US06/27238, dated Aug. 15, 2007.
Search Report from PCT/US06/27420, dated Apr. 26, 2007.
Advanced Television Systems Committee, ATSC Standard: Digital Audio Compression (AC-3), Revision A, 140 pp. (1995).
Beerends, "Audio Quality Determination Based on Perceptual Measurement Techniques," Applications of Digital Signal Processing to Audio and Acoustics, Chapter 1, Ed. Mark Kahrs, Karlheinz Brandenburg, Kluwer Acad. Publ., pp. 1-38 (1998).
Brandenburg, "ASPEC Coding", AES 10th International Conference, pp. 81-90 (1991).
Caetano et al., "Rate Control Strategy for Embedded Wavelet Video Coders," Electronics Letters, pp. 1815-1817 (Oct. 14, 1999).
De Luca, "AN1090 Application Note: STA013 MPEG 2.5 Layer III Source Decoder," STMicroelectronics, 17 pp. (1999).
de Queiroz et al., "Time-Varying Lapped Transforms and Wavelet Packets," IEEE Transactions on Signal Processing, vol. 41, pp. 3293-3305 (1993).
Dolby Laboratories, "AAC Technology," 4 pp. [Downloaded from the web site aac-audio.com on World Wide Web on Nov. 21, 2001.].
Fraunhofer-Gesellschaft, "MPEG Audio Layer-3," 4 pp. [Downloaded from the World Wide Web on Oct. 24, 2001.].
Fraunhofer-Gesellschaft, "MPEG-2 AAC," 3 pp. [Downloaded from the World Wide Web on Oct. 24, 2001.].
Gibson et al., Digital Compression for Multimedia, Title Page, Contents, "Chapter 7: Frequency Domain Coding," Morgan Kaufman Publishers, Inc., pp. iii, v-xi, and 227-262 (1998).
Mark Hasegawa-Johnson and Abeer Alwan, "Speech coding: fundamentals and applications," Handbook of Telecommunications, John Wiley and Sons, Inc., pp. 1-33 (2003). [available at http://citeseer.ist.psu.edu/617093.html].
Herley et al., "Tilings of the Time-Frequency Plane: Construction of Arbitrary Orthogonal Bases and Fast Tiling Algorithms," IEEE Transactions on Signal Processing, vol. 41, No. 12, pp. 3341-3359 (1993).
Herre et al., "MP3 Surround: Efficient and Compatible Coding of Multi-Channel Audio," 116th Audio Engineering Society Convention, 2004, 14 pages.
International Search Report and Written Opinion for PCT/US06/27420, dated Apr. 26, 2007, 8 pages.
"ISO/IEC 11172-3, Information Technology—Coding of Moving Pictures and Associated Audio for Digital Storage Media at Up to About 1.5 Mbit/s—Part 3: Audio," 154 pp. (1993).
"ISO/IEC 13818-7, Information Technology—Generic Coding of Moving Pictures and Associated Audio Information—Part 7: Advanced Audio Coding (AAC)," 174 pp. (1997).
"ISO/IEC 13818-7, Information Technology—Generic Coding of Moving Pictures and Associated Audio Information—Part 7: Advanced Audio Coding (AAC), Technical Corrigendum 1" 22 pp. (1998).
ITU, Recommendation ITU-R BS 1115, Low Bit-Rate Audio Coding, 9 pp. (1994).
ITU, Recommendation ITU-R BS 1387, Method for Objective Measurements of Perceived Audio Quality, 89 pp. (1998).
Jesteadt et al., "Forward Masking as a Function of Frequency, Masker Level, and Signal Delay," Journal of Acoustical Society of America, 71:950-962 (1982).
A.M. Kondoz, Digital Speech: Coding for Low Bit Rate Communications Systems, "Chapter 3.3: Linear Predictive Modeling of Speech Signals" and "Chapter 4: LPC Parameter Quantisation Using LSFs," John Wiley & Sons, pp. 42-53 and 79-97 (1994).
Korhonen et al., "Schemes for Error Resilient Streaming of Perceptually Coded Audio," Proceedings of the 2003 IEEE International Conference on Acoustics, Speech & Signal Processing, 2003, pp. 165-168.
Lau et al., "A Common Transform Engine for MPEG and AC3 Audio Decoder," IEEE Trans. Consumer Electron., vol. 43, Issue 3, Jun. 1997, pp. 559-566.
Lufti, "Additivity of Simultaneous Masking," Journal of Acoustic Society of America, 73:262-267 (1983).
Malvar, "Biorthogonal and Nonuniform Lapped Transforms for Transform Coding with Reduced Blocking and Ringing Artifacts," appeared in IEEE Transactions on Signal Processing, Special Issue on Multirate Systems, Filter Banks, Wavelets, and Applications, vol. 46, 29 pp. (1998).
H.S. Malvar, "Lapped Transforms for Efficient Transform/Subband Coding," IEEE Transactions on Acoustics, Speech and Signal Processing, vol. 38, No. 6, pp. 969-978 (1990).
H.S. Malvar, Signal Processing with Lapped Transforms, Artech House, Norwood, MA, pp. iv, vii-xi, 175-218, 353-357 (1992).
Najafzadeh-Azghandi, Hossein and Kabal, Peter, "Perceptual coding of narrowband audio signals at 8 Kbit/s" (1997), available at http://citeseer.ist.psu.edu/najafzadeh-azghandi97perceptual.html.
Noll, "Digital Audio Coding for Visual Communications," Proceedings of the IEEE, vol. 83, No. 6, Jun. 1995, pp. 925-943.
OPTICOM GmbH, "Objective Perceptual Measurement," 14 pp. [Downloaded from the World Wide Web on Oct. 24, 2001.].
Painter et al., "A Review of Algorithms for Perceptual Coding of Digital Audio Signals," Digital Signal Processing Proceedings, 1997, 30 pp.
Painter, T. and Spanias, A., "Perceptual Coding of Digital Audio," Proceedings of the IEEE, vol. 88, Issue 4, pp. 451-515, Apr. 2000, available at http://www.eas.asu.edu/~spanias/papers/paper-audio-tedspanias-00.pdf.
Phamdo, "Speech Compression," 13 pp. [Downloaded from the World Wide Web on Nov. 25, 2001.].
Ribas Corbera et al., "Rate Control in DCT Video Coding for Low-Delay Communications," IEEE Transactions on Circuits and Systems for Video Technology, vol. 9, No. 1, pp. 172-185 (Feb. 1999).
Rijkse, "H.263: Video Coding for Low-Bit-Rate Communication," IEEE Comm., vol. 34, No. 12, Dec. 1996, pp. 42-45.
Scheirer, "The MPEG-4 Structured Audio standard," Proc 1998 IEEE ICASSP, 1998, pp. 3801-3804.
M. Schroeder, B. Atal, "Code-excited linear prediction (CELP): High-quality speech at very low bit rates," Proc. IEEE Int. Conf ASSP, pp. 937-940, 1985.
Schulz, D., "Improving audio codecs by noise substitution," Journal of the AES, vol. 44, No. 7/8, pp. 593-598, Jul./Aug. 1996.
Seymour Shlien, "The Modulated Lapped Transform, Its Time-Varying Forms, and Its Application to Audio Coding Standards," IEEE Transactions on Speech and Audio Processing, vol. 5, No. 4, pp. 359-366 (Jul. 1997).
Solari, Digital Video and Audio Compression, Title Page, Contents, "Chapter 8: Sound and Audio," McGraw-Hill, Inc., pp. iii, v-vi, and 187-211 (1997).
Th. Sporer, Kh. Brandenburg, B. Edler, "The Use of Multirate Filter Banks for Coding of High Quality Digital Audio," 6th European Signal Processing Conference (EUSIPCO), Amsterdam, vol. 1, pp. 211-214, Jun. 1992.
Srinivasan et al., "High-Quality Audio Compression Using an Adaptive Wavelet Packet Decomposition and Psychoacoustic Modeling," IEEE Transactions on Signal Processing, vol. 46, No. 4, pp. 1085-1093 (Apr. 1998).
Terhardt, "Calculating Virtual Pitch," Hearing Research, 1:155-182 (1979).
Todd et. al., "AC-3: Flexible Perceptual Coding for Audio Transmission and Storage," 96th Conv. of AES, Feb. 1994, 16 pp.

Tucker, "Low bit-rate frequency extension coding," IEEE Colloquium on Audio and Music Technology, Nov. 1998, 5 pages.
Wragg et al., "An Optimised Software Solution for an ARM PoweredTM MP3 Decoder," 9 pp. [Downloaded from the World Wide Web on Oct. 27, 2001.].
Zwicker et al., Das Ohr als Nachriehtenempfanger, Title Page, Table of Contents, "I: Schallschwingungen," Index, Hirzel-Verlag, Stuttgart, pp. III, IX-XI, 1-26, and 231-232 (1967).
Zwicker, Psychoakustik, Title Page, Table of Contents, "Teil I: Einfuhrung," Index, Springer-Verlag, Berlin Heidelberg, New York, pp. II, IX-XI, 1-30, and 157-162 (1982).
Faller et al., "Binaural Cue Coding Applied to Stereo and Multi-Channel Audio Compression," *Audio Engineering Society, Presented at the 112th Convention*, May 2002, 9 pages.
Yang et al., "Progressive Syntax-Rich Coding of Multichannel Audio Sources," *EURASIP Journal on Applied Signal Processing*, 2003, pp. 980-992.
Malegate, "Lagrange-mesh R-matrix calculations," J. Phys. B: At. Mol. Opt. Phys. Sep. 27, 1994, pp. L691-L696.
Malvar, "A Modulated Complex Lapped Transform and its Applications to Audio Processing," IEEE International Conference on Acoustics, Speech, and Signal Processing, Mar. 1999, 9 pages.
Masanobu Abe, "Have a Chat with a Realer Voice," NTT Technical Journal, The Telecommunications Association, vol. 6, No. 11, 3 pages (No English translation available) (1994).
Davidson et al., "High-quality Audio Transform Coding at 128 Kbits/s," Int'l Conference on Acoustics, Speech, and Signal Processing (ICASSP-90), vol. 2, pp. 1117-1120 (1990).
Taka et al., "DSP Implementations of Sophisticated Speech Codecs," IEEE Journal on Selected Areas in Communications, vol. 6, No. 2, pp. 274-282 (1988).

* cited by examiner

Figure 13

$$\begin{bmatrix} C_0 \\ C_1 \end{bmatrix} \alpha \begin{bmatrix} C_0^* & C_1^* \end{bmatrix} = \begin{bmatrix} X_0 X_0^* & X_0 X_1^* \\ X_1 X_0^* & X_1 X_1^* \end{bmatrix}$$

$$C_0 C_0^* \alpha = X_0 X_0^*$$

$$C_1 C_1^* \alpha = X_1^* X_1^*$$

$$\mathrm{Re}(C_0 C_1^* \alpha) = \mathrm{Re}(X_0 X_1^*)$$

Figure 14

$$[C_0 C_0^* + C_1 C_1^* + 2\,\mathrm{Re}(C_0 C_1^*)] = \frac{1}{\beta^2}$$

$$|C_0|^2 + |C_1|^2 + 2|C_0||C_1|\cos(\phi_0 - \phi_1) = \frac{1}{\beta^2}$$

Figure 15

$$|C_0| = \sqrt{\frac{X_0 X_0^*}{\beta^2 (X_0 X_0^* + X_1^* X_1^* + 2\,\mathrm{Re}(X_0 X_1^*))}}$$

$$|C_1| = \sqrt{\frac{X_1 X_1^*}{\beta^2 (X_0 X_0^* + X_1^* X_1^* + 2\,\mathrm{Re}(X_0 X_1^*))}}$$

$$|C_0||C_1|\cos(\phi_0 - \phi_1) = \frac{\mathrm{Re}(X_0 X_1^*)}{\beta^2 (X_0 X_0^* + X_1^* X_1^* + 2\,\mathrm{Re}(X_0 X_1^*))}$$

Figure 16

$$\theta = \phi_0 - \phi_1 = \pm \mathrm{acos}\left( \frac{1 - \beta^2 |C_0|^2 - \beta^2 |C_1|^2}{2\beta^2 |C_0||C_1|} \right)$$

Figure 17

$$\mathrm{angle}[(|C_0| e^{j\phi_0} + |C_1| e^{j\phi_1})(B_0 X_0[l] + B_1 X_1[l])] = \mathrm{angle}(B_0 X_0[l] + B_1 X_1[l])$$

Figure 18

$$\phi_1 = \operatorname{atan}\left(\frac{-|C_0|\sin\theta}{|C_0|\cos\theta + |C_1|}\right)$$

$$\phi_0 = \operatorname{atan}\left(\frac{|C_1|\sin\theta}{|C_0| + |C_1|\cos\theta}\right) = \theta + \phi_1$$

Figure 19

$$|C_0|\cos\phi_0 = \frac{\beta^2|C_0|^2 - \beta^2|C_1|^2 + 1}{2\beta}$$

$$|C_1|\cos\phi_1 = \frac{\beta^2|C_1|^2 - \beta^2|C_0|^2 + 1}{2\beta}$$

Figure 20

$$|C_0|\sin\phi_0 = \sqrt{|C_0|^2 - (|C_0|\cos\phi_0)^2}$$

$$|C_1|\sin\phi_1 = \sqrt{|C_1|^2 - (|C_1|\cos\phi_0)^2}$$

Figure 21

$$\begin{bmatrix} W_0 \\ W_{0F} \\ W_1 \\ W_{1F} \end{bmatrix}$$

Figure 22

$$\begin{bmatrix} S_0 \\ S_1 \end{bmatrix} = \begin{bmatrix} a & b & 0 & 0 \\ 0 & 0 & c & d \end{bmatrix} \begin{bmatrix} W_0 \\ W_{0F} \\ W_1 \\ W_{1F} \end{bmatrix}$$

Figure 23

$$\begin{bmatrix} S_0 \\ S_1 \end{bmatrix} = \begin{bmatrix} aC_0 & bC_0 \\ cC_1 & dC_1 \end{bmatrix} \begin{bmatrix} Z_0 \\ Z_{0F} \end{bmatrix} = \begin{bmatrix} aC_0 & b/a & 0 \\ cC_1 & 0 & d/c \end{bmatrix} \begin{bmatrix} Z_0 \\ W_{0F} \\ W_{1F} \end{bmatrix}$$

Figure 24

$$R_{XX} = \begin{bmatrix} X_0X_0^* & X_0X_1^* \\ X_1X_0^* & X_1X_1^* \end{bmatrix} = U\Lambda U^*$$

Figure 25

$$\frac{R_{XX}}{\alpha} = \begin{bmatrix} |C_0|^2 & |C_0||C_1|\cos\theta + j\,\mathrm{Im}(X_0X_1^*)/\alpha \\ |C_0||C_1|\cos\theta - j\,\mathrm{Im}(X_0X_1^*)/\alpha & |C_1|^2 \end{bmatrix} = U\frac{\Lambda}{\alpha}U^*$$

Figure 26

$$\frac{R_{XX}}{|X_0||X_1|} = \begin{bmatrix} X_0X_0^*/|X_0||X_1| & X_0X_1^*/|X_0||X_1| \\ X_1X_0^*/|X_0||X_1| & X_1X_1^*/|X_0||X_1| \end{bmatrix} = \begin{bmatrix} R_{00} & R_{01} \\ R_{01}^* & 1/R_{00} \end{bmatrix}$$

Figure 27

$$\frac{|X_0||X_1|}{\alpha} = \frac{|X_0||X_1|}{[X_0X_0^* + X_1X_1^* + 2\,\mathrm{Re}(X_0X_1^*)]\beta^2} = \frac{1}{[R_{00} + (1/R_{00}) + 2\,\mathrm{Re}(R_{01})]\beta^2}$$

Figure 28

$$U\left(\frac{\Lambda}{\alpha}\right)^{1/2} V\alpha V^* \left(\frac{\Lambda}{\alpha}\right)^{1/2} U^* = U\Lambda U^*$$

$$U\left(\frac{\Lambda}{\alpha}\right)^{1/2} V = \begin{bmatrix} aC_0 & bC_0 \\ cC_1 & dC_1 \end{bmatrix}$$

Figure 29

$$U\left(\frac{\Lambda}{\alpha}\right)^{1/2}V=\begin{bmatrix}u_{00} & u_{01}\\ u_{10} & u_{11}\end{bmatrix}\begin{bmatrix}\cos\omega & \sin\omega\\ -\sin\omega & \cos\omega\end{bmatrix}=\begin{bmatrix}u_{00}\cos\omega-u_{10}\sin\omega & u_{00}\sin\omega+u_{01}\cos\omega\\ u_{10}\cos\omega-u_{11}\sin\omega & u_{10}\sin\omega+u_{11}\cos\omega\end{bmatrix}$$

Figure 30

$$u_{00}\sin\omega+u_{01}\cos\omega=-(u_{10}\sin\omega+u_{11}\cos\omega)$$
$$\omega=\operatorname{atan2}(-u_{11}-u_{01},u_{00}+u_{10})$$

Figure 31

$$\begin{bmatrix}aC_0 & b/a & 0\\ cC_1 & 0 & d/c\end{bmatrix}$$

Figure 32

$$W_{0F}^{'}=W_{0F}a|C_0|\left(\frac{|Z_0|}{|W_{0F}|}\right),$$
$$|W_{0F}^{'}|=|Z_0|a|C_0|$$

Figure 33

If: $|W_{0F}|\geq|Z_0|a|C_0|*T$ then: $W_{0F}=W_{0F}a|C_0|\left(\frac{|Z_0|}{|W_{0F}|}\right)T$ for some constant $T$.

CHANNEL EXTENSION CODING FOR MULTI-CHANNEL SOURCE

BACKGROUND

Perceptual Transform Coding

The coding of audio utilizes coding techniques that exploit various perceptual models of human hearing. For example, many weaker tones near strong ones are masked so they do not need to be coded. In traditional perceptual audio coding, this is exploited as adaptive quantization of different frequency data. Perceptually important frequency data are allocated more bits and thus finer quantization and vice versa.

For example, transform coding is conventionally known as an efficient scheme for the compression of audio signals. In transform coding, a block of the input audio samples is transformed (e.g., via the Modified Discrete Cosine Transform or MDCT, which is the most widely used), processed, and quantized. The quantization of the transformed coefficients is performed based on the perceptual importance (e.g. masking effects and frequency sensitivity of human hearing), such as via a scalar quantizer.

When a scalar quantizer is used, the importance is mapped to relative weighting, and the quantizer resolution (step size) for each coefficient is derived from its weight and the global resolution. The global resolution can be determined from target quality, bit rate, etc. For a given step size, each coefficient is quantized into a level which is zero or non-zero integer value.

At lower bitrates, there are typically a lot more zero level coefficients than non-zero level coefficients. They can be coded with great efficiency using run-length coding. In run-length coding, all zero-level coefficients typically are represented by a value pair consisting of a zero run (i.e., length of a run of consecutive zero-level coefficients), and level of the non-zero coefficient following the zero run. The resulting sequence is $R_0,L_0,R_1,L_1 \ldots$, where R is zero run and L is non-zero level.

By exploiting the redundancies between R and L, it is possible to further improve the coding performance. Run-level Huffman coding is a reasonable approach to achieve it, in which R and L are combined into a 2-D array (R,L) and Huffman-coded. Because of memory restrictions, the entries in Huffman tables cannot cover all possible (R,L) combinations, which requires special handling of the outliers. A typical method used for the outliers is to embed an escape code into the Huffman tables, such that the outlier is coded by transmitting the escape code along with the independently quantized R and L.

When transform coding at low bit rates, a large number of the transform coefficients tend to be quantized to zero to achieve a high compression ratio. This could result in there being large missing portions of the spectral data in the compressed bitstream. After decoding and reconstruction of the audio, these missing spectral portions can produce an unnatural and annoying distortion in the audio. Moreover, the distortion in the audio worsens as the missing portions of spectral data become larger. Further, a lack of high frequencies due to quantization makes the decoded audio sound muffled and unpleasant.

Wide-Sense Perceptual Similarity

Perceptual coding also can be taken to a broader sense. For example, some parts of the spectrum can be coded with appropriately shaped noise. When taking this approach, the coded signal may not aim to render an exact or near exact version of the original. Rather the goal is to make it sound similar and pleasant when compared with the original. For example, a wide-sense perceptual similarity technique may code a portion of the spectrum as a scaled version of a code-vector, where the code vector may be chosen from either a fixed predetermined codebook (e.g., a noise codebook), or a codebook taken from a baseband portion of the spectrum (e.g., a baseband codebook).

All these perceptual effects can be used to reduce the bit-rate needed for coding of audio signals. This is because some frequency components do not need to be accurately represented as present in the original signal, but can be either not coded or replaced with something that gives the same perceptual effect as in the original.

In low bit rate coding, a recent trend is to exploit this wide-sense perceptual similarity and use a vector quantization (e.g., as a gain and shape code-vector) to represent the high frequency components with very few bits, e.g., 3 kbps. This can alleviate the distortion and unpleasant muffled effect from missing high frequencies and other spectral "holes." The transform coefficients of the "spectral holes" are encoded using the vector quantization scheme. It has been shown that this approach enhances the audio quality with a small increase of bit rate.

Multi-Channel Coding

Some audio encoder/decoders also provide the capability to encode multiple channel audio. Joint coding of audio channels involves coding information from more than one channel together to reduce bitrate. For example, mid/side coding (also called M/S coding or sum-difference coding) involves performing a matrix operation on left and right stereo channels at an encoder, and sending resulting "mid" and "side" channels (normalized sum and difference channels) to a decoder. The decoder reconstructs the actual physical channels from the "mid" and "side" channels. M/S coding is lossless, allowing perfect reconstruction if no other lossy techniques (e.g., quantization) are used in the encoding process.

Intensity stereo coding is an example of a lossy joint coding technique that can be used at low bitrates. Intensity stereo coding involves summing a left and right channel at an encoder and then scaling information from the sum channel at a decoder during reconstruction of the left and right channels. Typically, intensity stereo coding is performed at higher frequencies where the artifacts introduced by this lossy technique are less noticeable.

Previous known multi-channel coding techniques had designs that were mostly practical for audio having two source channels.

SUMMARY

The following Detailed Description concerns various audio encoding/decoding techniques and tools that provide a way to encode multi-channel audio at low bit rates. More particularly, the multi-channel coding described herein can be applied to audio systems having more than two source channels.

In basic form, an encoder encodes a subset of the physical channels from a multi-channel source (e.g., as a set of folded-down "virtual" channels that is derived from the physical channels). Additionally, the encoder encodes side information that describes the power and cross channel correlations (such as, the correlation between the physical channels, or the correlation between the physical channels and the coded channels). This enables the reconstruction by a decoder of all the physical channels from the coded channels. The coded channels and side information can be encoded using fewer bits compared to encoding all of the physical channels.

In one form of the multi-channel coding technique herein, the encoder attempts to preserve a full correlation matrix. The decoder reconstructs a set of physical channels from the coded channels using parameters that specify the correlation matrix of the original channels, or alternatively that of a transformed version of the original channels.

An alternative form of the multi-channel coding technique preserves some of the second order statistics of the cross channel correlations (e.g., power and some of the cross-correlations). In one implementation example, the decoder reconstructs physical channels from the coded channels using parameters that specify the power in the original physical channels with respect to the power in the coded channels. For better reconstruction, the encoder may encode additional parameters that specify the cross-correlation between the physical channels, or alternatively the cross-correlation between physical channels and coded channels.

In one implementation example, the encoder sends these parameters on a per band basis. It is not necessary for the parameters to be sent for every subframe of the multi-channel audio. Instead, the encoder may send the parameters once per a number N of subframes. At the decoder, the parameters for a specific intermediate subframe can be determined via interpolation from the sent parameters.

In another implementation example, the reconstruction of the physical channels by the decoder can be done from "virtual" channels that are obtained as a linear combination of the coded channels. This approach can be used to reduce channel cross-talk between certain physical channels. In one example, a 5.1 input source consisting of left (L), right (R), center (C), back-left (BL), back-right (BR) and subwoofer (S) could be encoded as two coded channels, as follows:

$$X=a*(L)+b*(BL)+c*(C)-d*(S)$$

$$Y=a*(R)+b*(BR)+c*(C)+d*(S)$$

The decoder in this example reconstructs the center channel using the sum of the two coded channels (X,Y), and uses a difference between the two coded channels to reconstruct the surround channel. This provides separation between the center and subwoofer channels. This example decoder further reconstructs the left (L) and back-left (BL) from the first coded channel (X), and reconstructs the right (R) and back-right (BR) channels from the second coded channel (Y).

This Summary is provided to introduce a selection of concepts in a simplified form that is further described below in the Detailed Description. This summary is not intended to identify key features or essential features of the claimed subject matter, nor is it intended to be used as an aid in determining the scope of the claimed subject matter. Additional features and advantages of the invention will be made apparent from the following detailed description of embodiments that proceeds with reference to the accompanying drawings.

BRIEF DESCRIPTION OF THE DRAWINGS

FIGS. 13-33 are equations and related matrix arrangements showing details of channel extension processing in some implementations.

DETAILED DESCRIPTION

Various techniques and tools for representing, coding, and decoding audio information are described. These techniques and tools facilitate the creation, distribution, and playback of high quality audio content, even at very low bitrates.

The various techniques and tools described herein may be used independently. Some of the techniques and tools may be used in combination (e.g., in different phases of a combined encoding and/or decoding process).

Various techniques are described below with reference to flowcharts of processing acts. The various processing acts shown in the flowcharts may be consolidated into fewer acts or separated into more acts. For the sake of simplicity, the relation of acts shown in a particular flowchart to acts described elsewhere is often not shown. In many cases, the acts in a flowchart can be reordered.

Much of the detailed description addresses representing, coding, and decoding audio information. Many of the techniques and tools described herein for representing, coding, and decoding audio information can also be applied to video information, still image information, or other media information sent in single or multiple channels.

I. Computing Environment

Figure 1:
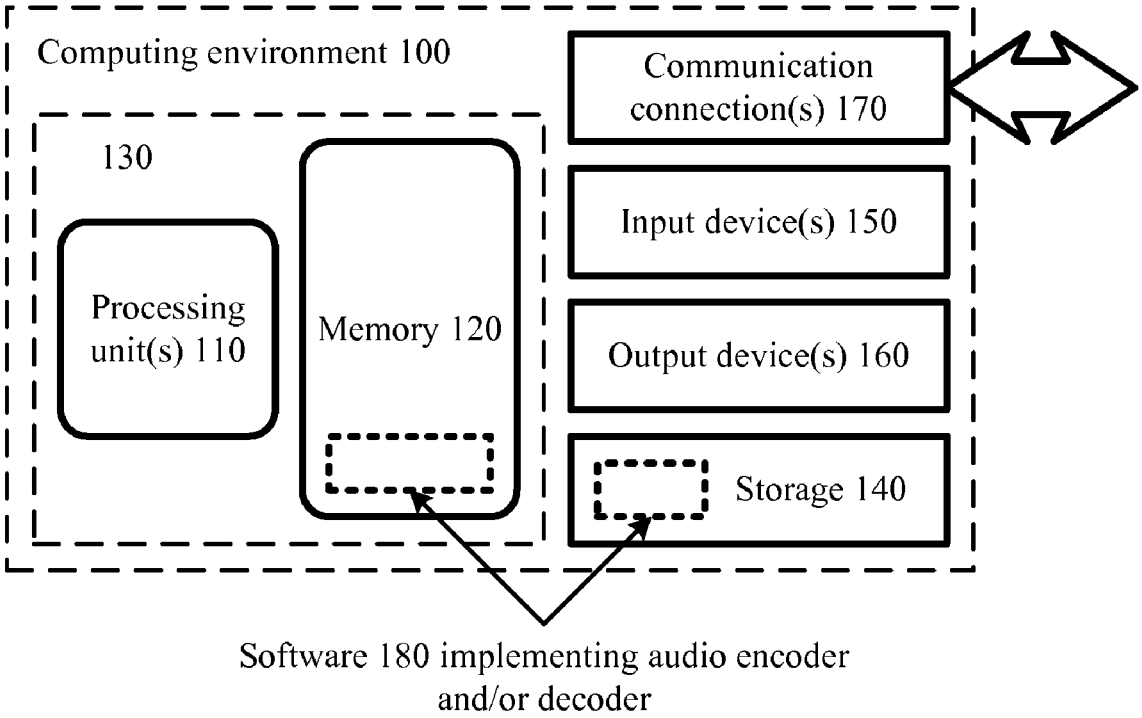
FIG. 1 is a block diagram of a generalized operating environment in conjunction with which various described embodiments may be implemented.

FIG. 1 illustrates a generalized example of a suitable computing environment 100 in which described embodiments may be implemented. The computing environment 100 is not intended to suggest any limitation as to scope of use or functionality, as described embodiments may be implemented in diverse general-purpose or special-purpose computing environments.

With reference to FIG. 1, the computing environment 100 includes at least one processing unit 110 and memory 120. In FIG. 1, this most basic configuration 130 is included within a dashed line. The processing unit 110 executes computer-executable instructions and may be a real or a virtual processor. In a multi-processing system, multiple processing units execute computer-executable instructions to increase processing power. The processing unit also can comprise a central processing unit and co-processors, and/or dedicated or special purpose processing units (e.g., an audio processor). The memory 120 may be volatile memory (e.g., registers, cache, RAM), non-volatile memory (e.g., ROM, EEPROM, flash memory), or some combination of the two. The memory 120 stores software 180 implementing one or more audio processing techniques and/or systems according to one or more of the described embodiments.

A computing environment may have additional features. For example, the computing environment 100 includes storage 140, one or more input devices 150, one or more output devices 160, and one or more communication connections 170. An interconnection mechanism (not shown) such as a bus, controller, or network interconnects the components of the computing environment 100. Typically, operating system software (not shown) provides an operating environment for software executing in the computing environment 100 and coordinates activities of the components of the computing environment 100.

The storage 140 may be removable or non-removable, and includes magnetic disks, magnetic tapes or cassettes, CDs, DVDs, or any other medium which can be used to store information and which can be accessed within the computing environment 100. The storage 140 stores instructions for the software 180.

The input device(s) 150 may be a touch input device such as a keyboard, mouse, pen, touchscreen or trackball, a voice input device, a scanning device, or another device that provides input to the computing environment 100. For audio or video, the input device(s) 150 may be a microphone, sound card, video card, TV tuner card, or similar device that accepts audio or video input in analog or digital form, or a CD or DVD that reads audio or video samples into the computing environment. The output device(s) 160 may be a display, printer, speaker, CD/DVD-writer, network adapter, or another device that provides output from the computing environment 100.

The communication connection(s) 170 enable communication over a communication medium to one or more other computing entities. The communication medium conveys information such as computer-executable instructions, audio or video information, or other data in a data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

Embodiments can be described in the general context of computer-readable media. Computer-readable media are any available media that can be accessed within a computing environment. By way of example, and not limitation, with the computing environment 100, computer-readable media include memory 120, storage 140, communication media, and combinations of any of the above.

Embodiments can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular data types. The functionality of the program modules may be combined or split between program modules as desired in various embodiments. Computer-executable instructions for program modules may be executed within a local or distributed computing environment.

For the sake of presentation, the detailed description uses terms like "determine," "receive," and "perform" to describe computer operations in a computing environment. These terms are high-level abstractions for operations performed by a computer, and should not be confused with acts performed by a human being. The actual computer operations corresponding to these terms vary depending on implementation.

II. Example Encoders and Decoders

Figure 2:
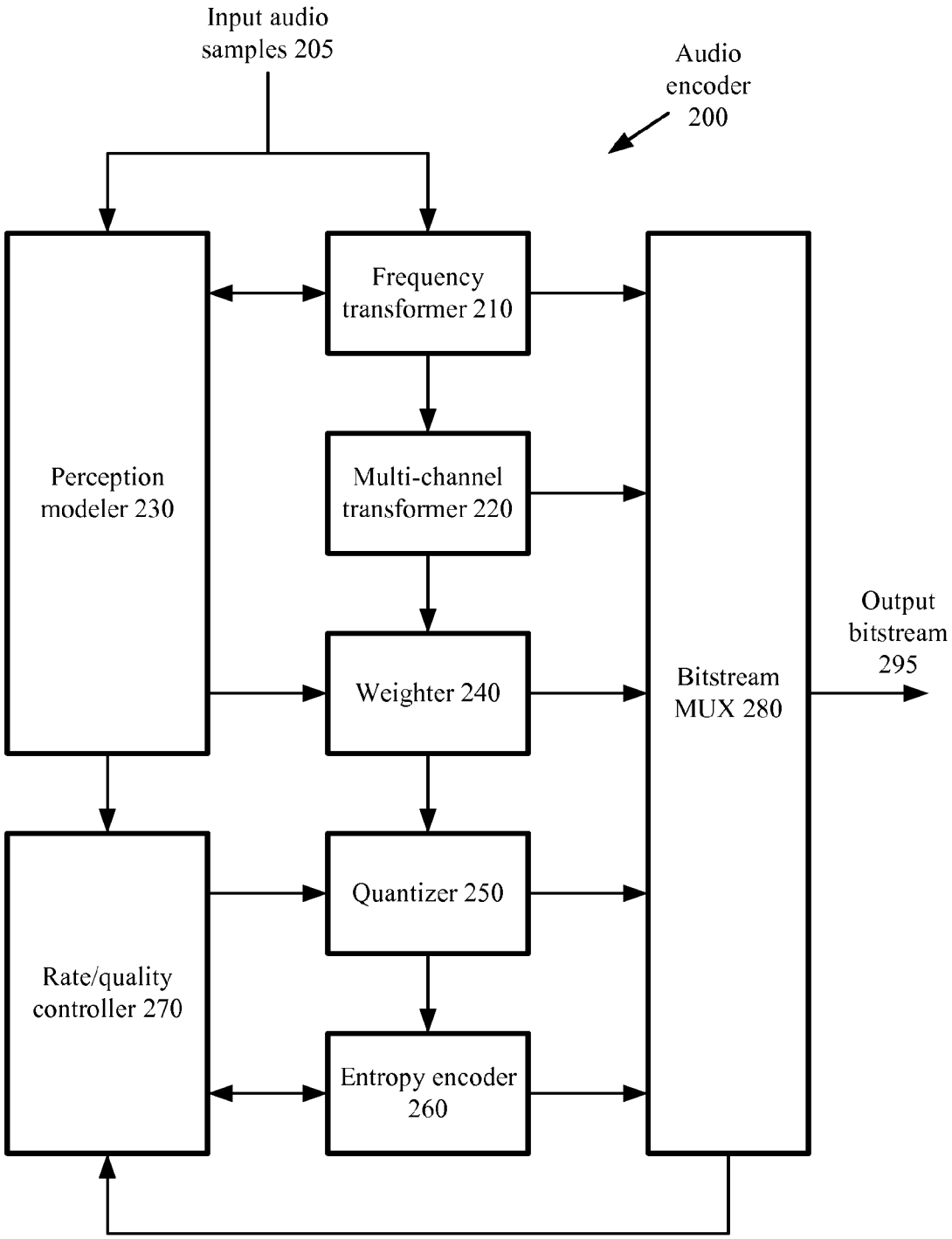
FIGS. 2, 3, 4, and 5 are block diagrams of generalized encoders and/or decoders in conjunction with which various described embodiments may be implemented.
Figure 3:
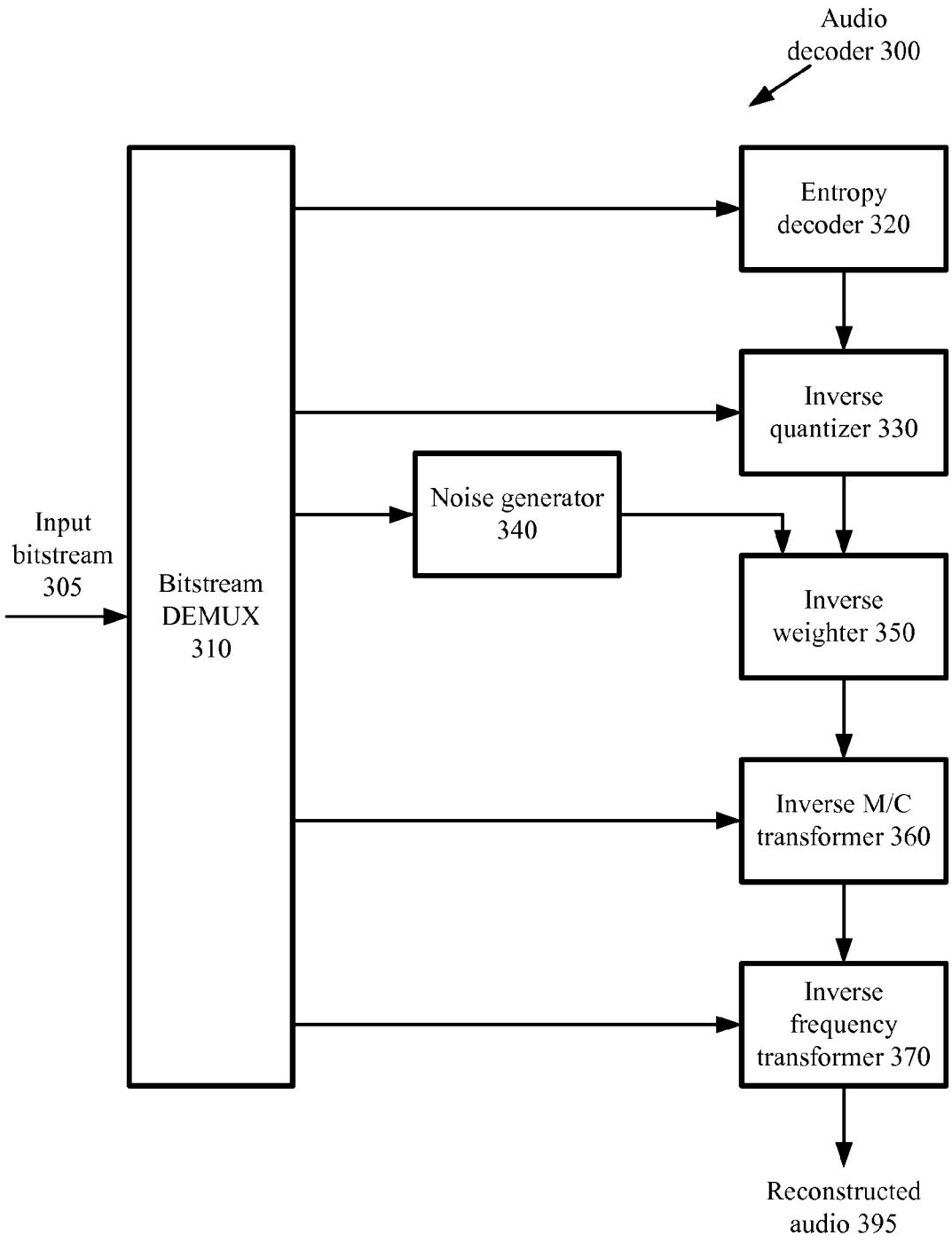

FIG. 2 shows a first audio encoder 200 in which one or more described embodiments may be implemented. The encoder 200 is a transform-based, perceptual audio encoder 200. FIG. 3 shows a corresponding audio decoder 300.

Figure 4:
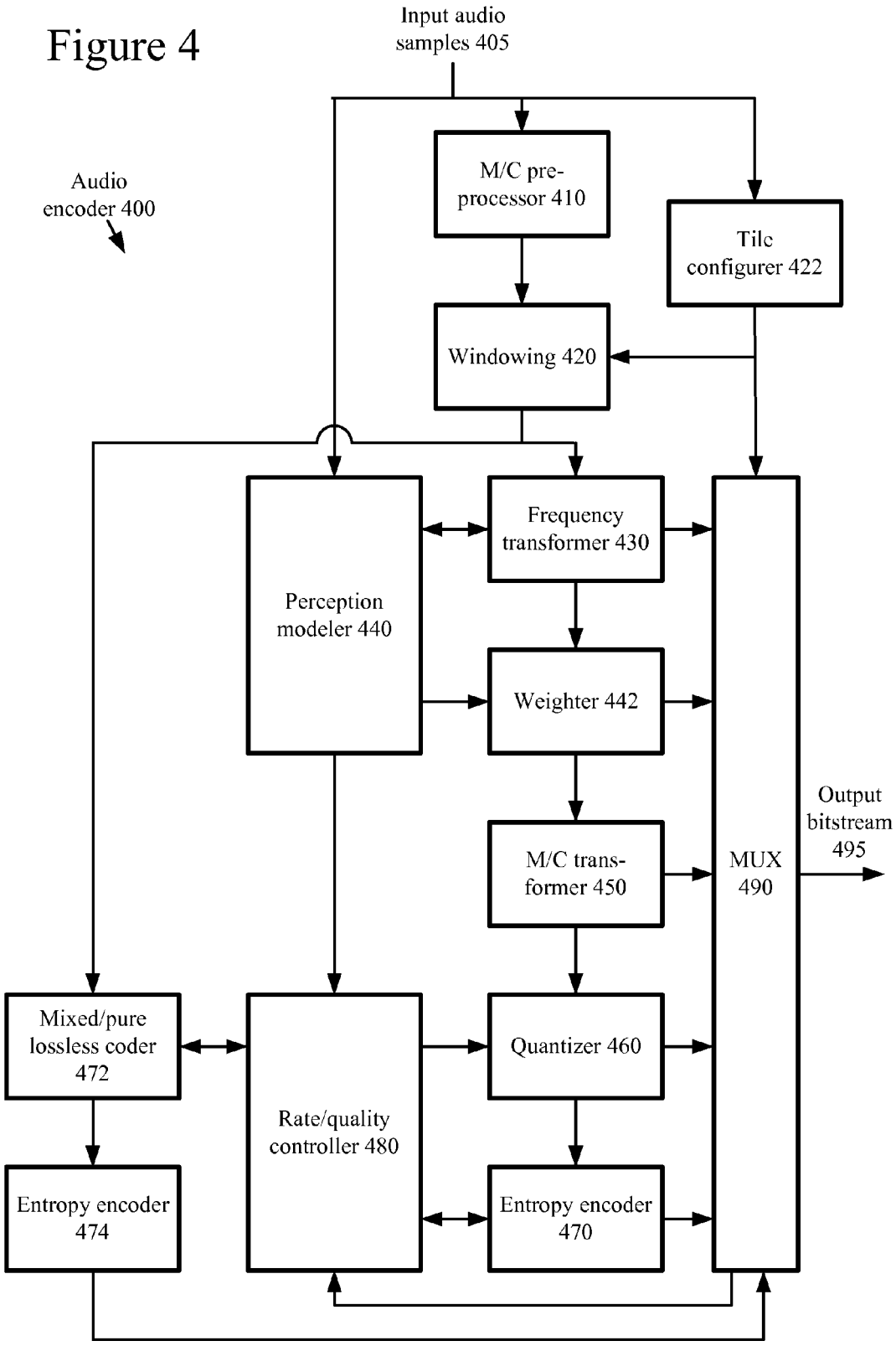
Figure 5:
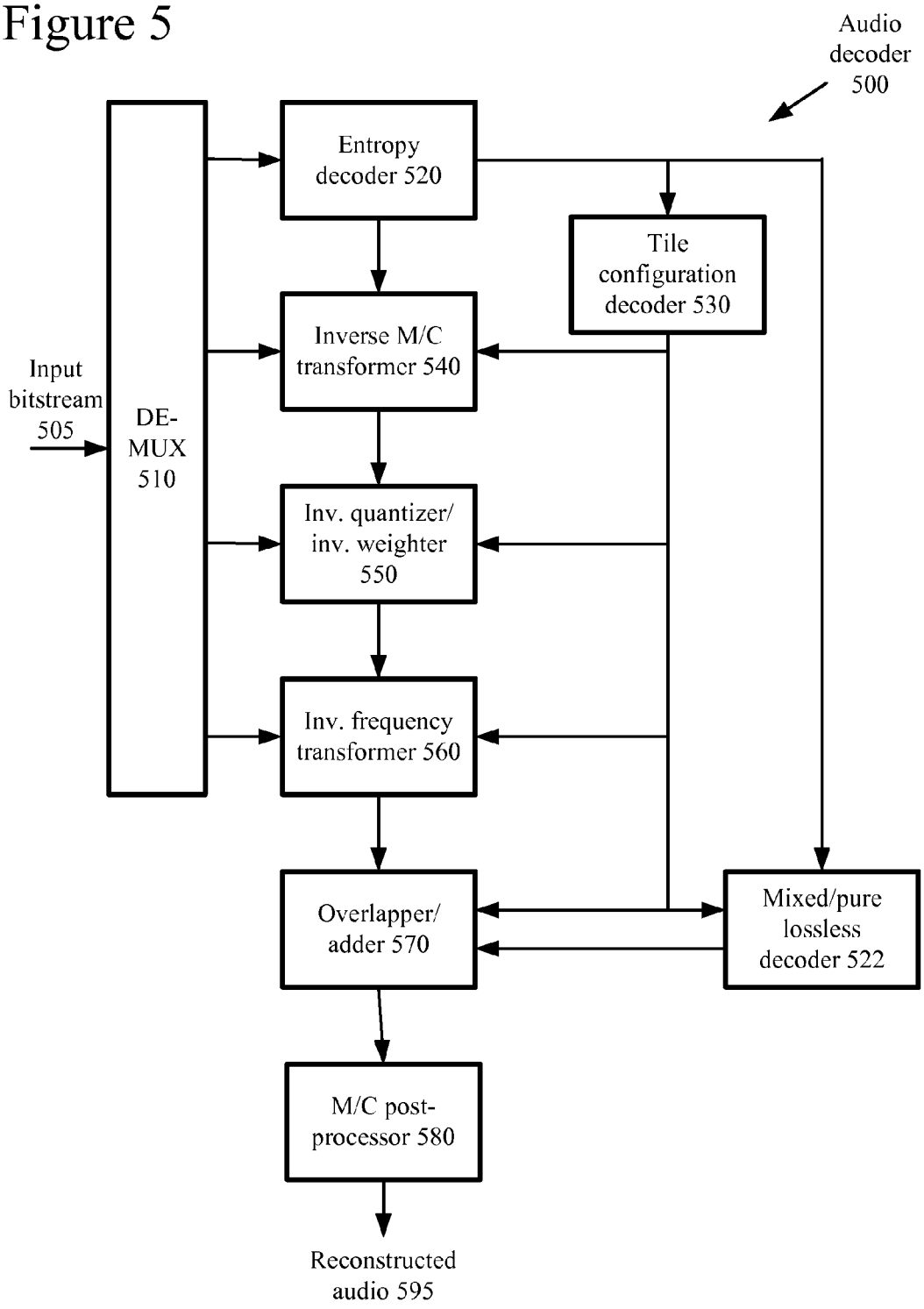

FIG. 4 shows a second audio encoder 400 in which one or more described embodiments may be implemented. The encoder 400 is again a transform-based, perceptual audio encoder, but the encoder 400 includes additional modules, such as modules for processing multi-channel audio. FIG. 5 shows a corresponding audio decoder 500.

Though the systems shown in FIGS. 2 through 5 are generalized, each has characteristics found in real world systems. In any case, the relationships shown between modules within the encoders and decoders indicate flows of information in the encoders and decoders; other relationships are not shown for the sake of simplicity. Depending on implementation and the type of compression desired, modules of an encoder or decoder can be added, omitted, split into multiple modules, combined with other modules, and/or replaced with like modules. In alternative embodiments, encoders or decoders with different modules and/or other configurations process audio data or some other type of data according to one or more described embodiments.

A. First Audio Encoder

The encoder 200 receives a time series of input audio samples 205 at some sampling depth and rate. The input audio samples 205 are for multi-channel audio (e.g., stereo) or mono audio. The encoder 200 compresses the audio samples 205 and multiplexes information produced by the various modules of the encoder 200 to output a bitstream 295 in a compression format such as a WMA format, a container format such as Advanced Streaming Format ("ASF"), or other compression or container format.

The frequency transformer 210 receives the audio samples 205 and converts them into data in the frequency (or spectral) domain. For example, the frequency transformer 210 splits the audio samples 205 of frames into sub-frame blocks, which can have variable size to allow variable temporal resolution. Blocks can overlap to reduce perceptible discontinuities between blocks that could otherwise be introduced by later quantization. The frequency transformer 210 applies to blocks a time-varying Modulated Lapped Transform ("MLT"), modulated DCT ("MDCT"), some other variety of MLT or DCT, or some other type of modulated or non-modulated, overlapped or non-overlapped frequency transform, or uses sub-band or wavelet coding. The frequency transformer 210 outputs blocks of spectral coefficient data and outputs side information such as block sizes to the multiplexer ("MUX") 280.

For multi-channel audio data, the multi-channel transformer 220 can convert the multiple original, independently coded channels into jointly coded channels. Or, the multi-channel transformer 220 can pass the left and right channels through as independently coded channels. The multi-channel transformer 220 produces side information to the MUX 280 indicating the channel mode used. The encoder 200 can apply multi-channel rematrixing to a block of audio data after a multi-channel transform.

The perception modeler 230 models properties of the human auditory system to improve the perceived quality of the reconstructed audio signal for a given bitrate. The perception modeler 230 uses any of various auditory models and passes excitation pattern information or other information to the weighter 240. For example, an auditory model typically considers the range of human hearing and critical bands (e.g., Bark bands). Aside from range and critical bands, interactions between audio signals can dramatically affect perception. In addition, an auditory model can consider a variety of other factors relating to physical or neural aspects of human perception of sound.

The perception modeler 230 outputs information that the weighter 240 uses to shape noise in the audio data to reduce the audibility of the noise. For example, using any of various techniques, the weighter 240 generates weighting factors for quantization matrices (sometimes called masks) based upon the received information. The weighting factors for a quantization matrix include a weight for each of multiple quantization bands in the matrix, where the quantization bands are frequency ranges of frequency coefficients. Thus, the weighting factors indicate proportions at which noise/quantization error is spread across the quantization bands, thereby controlling spectral/temporal distribution of the noise/quantization error, with the goal of minimizing the audibility of the noise by putting more noise in bands where it is less audible, and vice versa.

The weighter 240 then applies the weighting factors to the data received from the multi-channel transformer 220.

The quantizer 250 quantizes the output of the weighter 240, producing quantized coefficient data to the entropy encoder 260 and side information including quantization step size to the MUX 280. In FIG. 2, the quantizer 250 is an adaptive, uniform, scalar quantizer. The quantizer 250 applies the same quantization step size to each spectral coefficient, but the quantization step size itself can change from one iteration of a quantization loop to the next to affect the bitrate of the entropy encoder 260 output. Other kinds of quantization are non-uniform, vector quantization, and/or non-adaptive quantization.

The entropy encoder 260 losslessly compresses quantized coefficient data received from the quantizer 250, for example, performing run-level coding and vector variable length coding. The entropy encoder 260 can compute the number of bits spent encoding audio information and pass this information to the rate/quality controller 270.

The controller 270 works with the quantizer 250 to regulate the bitrate and/or quality of the output of the encoder 200. The controller 270 outputs the quantization step size to the quantizer 250 with the goal of satisfying bitrate and quality constraints.

In addition, the encoder 200 can apply noise substitution and/or band truncation to a block of audio data.

The MUX 280 multiplexes the side information received from the other modules of the audio encoder 200 along with the entropy encoded data received from the entropy encoder 260. The MUX 280 can include a virtual buffer that stores the bitstream 295 to be output by the encoder 200.

B. First Audio Decoder

The decoder 300 receives a bitstream 305 of compressed audio information including entropy encoded data as well as side information, from which the decoder 300 reconstructs audio samples 395.

The demultiplexer ("DEMUX") 310 parses information in the bitstream 305 and sends information to the modules of the decoder 300. The DEMUX 310 includes one or more buffers to compensate for short-term variations in bitrate due to fluctuations in complexity of the audio, network jitter, and/or other factors.

The entropy decoder 320 losslessly decompresses entropy codes received from the DEMUX 310, producing quantized spectral coefficient data. The entropy decoder 320 typically applies the inverse of the entropy encoding techniques used in the encoder.

The inverse quantizer 330 receives a quantization step size from the DEMUX 310 and receives quantized spectral coefficient data from the entropy decoder 320. The inverse quantizer 330 applies the quantization step size to the quantized frequency coefficient data to partially reconstruct the frequency coefficient data, or otherwise performs inverse quantization.

From the DEMUX 310, the noise generator 340 receives information indicating which bands in a block of data are noise substituted as well as any parameters for the form of the noise. The noise generator 340 generates the patterns for the indicated bands, and passes the information to the inverse weighter 350.

The inverse weighter 350 receives the weighting factors from the DEMUX 310, patterns for any noise-substituted bands from the noise generator 340, and the partially reconstructed frequency coefficient data from the inverse quantizer 330. As necessary, the inverse weighter 350 decompresses weighting factors. The inverse weighter 350 applies the weighting factors to the partially reconstructed frequency coefficient data for bands that have not been noise substituted. The inverse weighter 350 then adds in the noise patterns received from the noise generator 340 for the noise-substituted bands.

The inverse multi-channel transformer 360 receives the reconstructed spectral coefficient data from the inverse weighter 350 and channel mode information from the DEMUX 310. If multi-channel audio is in independently coded channels, the inverse multi-channel transformer 360 passes the channels through. If multi-channel data is in jointly coded channels, the inverse multi-channel transformer 360 converts the data into independently coded channels.

The inverse frequency transformer 370 receives the spectral coefficient data output by the multi-channel transformer 360 as well as side information such as block sizes from the DEMUX 310. The inverse frequency transformer 370 applies the inverse of the frequency transform used in the encoder and outputs blocks of reconstructed audio samples 395.

C. Second Audio Encoder

With reference to FIG. 4, the encoder 400 receives a time series of input audio samples 405 at some sampling depth and rate. The input audio samples 405 are for multi-channel audio (e.g., stereo, surround) or mono audio. The encoder 400 compresses the audio samples 405 and multiplexes information produced by the various modules of the encoder 400 to output a bitstream 495 in a compression format such as a WMA Pro format, a container format such as ASF, or other compression or container format.

The encoder 400 selects between multiple encoding modes for the audio samples 405. In FIG. 4, the encoder 400 switches between a mixed/pure lossless coding mode and a lossy coding mode. The lossless coding mode includes the mixed/pure lossless coder 472 and is typically used for high quality (and high bitrate) compression. The lossy coding mode includes components such as the weighter 442 and quantizer 460 and is typically used for adjustable quality (and controlled bitrate) compression. The selection decision depends upon user input or other criteria.

For lossy coding of multi-channel audio data, the multi-channel pre-processor 410 optionally re-matrixes the time-domain audio samples 405. For example, the multi-channel pre-processor 410 selectively re-matrixes the audio samples 405 to drop one or more coded channels or increase inter-channel correlation in the encoder 400, yet allow reconstruction (in some form) in the decoder 500. The multi-channel pre-processor 410 may send side information such as instructions for multi-channel post-processing to the MUX 490.

The windowing module 420 partitions a frame of audio input samples 405 into sub-frame blocks (windows). The windows may have time-varying size and window shaping functions. When the encoder 400 uses lossy coding, variable-size windows allow variable temporal resolution. The windowing module 420 outputs blocks of partitioned data and outputs side information such as block sizes to the MUX 490.

In FIG. 4, the tile configurer 422 partitions frames of multi-channel audio on a per-channel basis. The tile configurer 422 independently partitions each channel in the frame, if quality/bitrate allows. This allows, for example, the tile configurer 422 to isolate transients that appear in a particular channel with smaller windows, but use larger windows for frequency resolution or compression efficiency in other channels. This can improve compression efficiency by isolating transients on a per channel basis, but additional information specifying the partitions in individual channels is needed in many cases. Windows of the same size that are co-located in time may qualify for further redundancy reduction through multi-channel transformation. Thus, the tile configurer 422 groups windows of the same size that are co-located in time as a tile.

Figure 6:
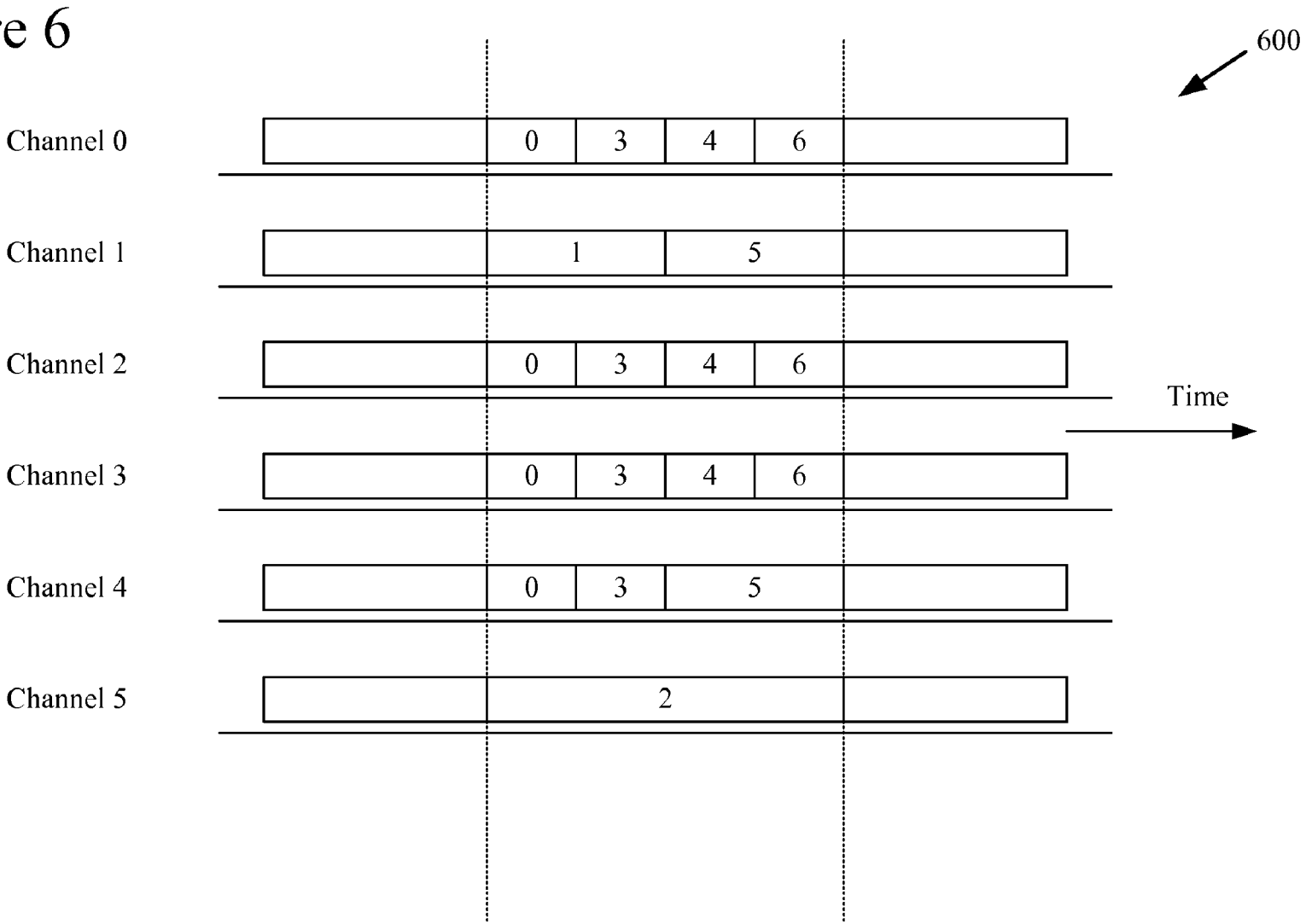
FIG. 6 is a diagram showing an example tile configuration.

FIG. 6 shows an example tile configuration 600 for a frame of 5.1 channel audio. The tile configuration 600 includes seven tiles, numbered 0 through 6. Tile 0 includes samples from channels 0, 2, 3, and 4 and spans the first quarter of the frame. Tile 1 includes samples from channel 1 and spans the first half of the frame. Tile 2 includes samples from channel 5 and spans the entire frame. Tile 3 is like tile 0, but spans the second quarter of the frame. Tiles 4 and 6 include samples in channels 0, 2, and 3, and span the third and fourth quarters, respectively, of the frame. Finally, tile 5 includes samples from channels 1 and 4 and spans the last half of the frame. As shown, a particular tile can include windows in non-contiguous channels.

The frequency transformer 430 receives audio samples and converts them into data in the frequency domain, applying a transform such as described above for the frequency transformer 210 of FIG. 2. The frequency transformer 430 outputs blocks of spectral coefficient data to the weighter 442 and outputs side information such as block sizes to the MUX 490. The frequency transformer 430 outputs both the frequency coefficients and the side information to the perception modeler 440.

The perception modeler 440 models properties of the human auditory system, processing audio data according to an auditory model, generally as described above with reference to the perception modeler 230 of FIG. 2.

The weighter 442 generates weighting factors for quantization matrices based upon the information received from the perception modeler 440, generally as described above with reference to the weighter 240 of FIG. 2. The weighter 442 applies the weighting factors to the data received from the frequency transformer 430. The weighter 442 outputs side information such as the quantization matrices and channel weight factors to the MUX 490. The quantization matrices can be compressed.

For multi-channel audio data, the multi-channel transformer 450 may apply a multi-channel transform to take advantage of inter-channel correlation. For example, the multi-channel transformer 450 selectively and flexibly applies the multi-channel transform to some but not all of the channels and/or quantization bands in the tile. The multi-channel transformer 450 selectively uses pre-defined matrices or custom matrices, and applies efficient compression to the custom matrices. The multi-channel transformer 450 produces side information to the MUX 490 indicating, for example, the multi-channel transforms used and multi-channel transformed parts of tiles.

The quantizer 460 quantizes the output of the multi-channel transformer 450, producing quantized coefficient data to the entropy encoder 470 and side information including quantization step sizes to the MUX 490. In FIG. 4, the quantizer 460 is an adaptive, uniform, scalar quantizer that computes a quantization factor per tile, but the quantizer 460 may instead perform some other kind of quantization.

The entropy encoder 470 losslessly compresses quantized coefficient data received from the quantizer 460, generally as described above with reference to the entropy encoder 260 of FIG. 2.

The controller 480 works with the quantizer 460 to regulate the bitrate and/or quality of the output of the encoder 400. The controller 480 outputs the quantization factors to the quantizer 460 with the goal of satisfying quality and/or bitrate constraints.

The mixed/pure lossless encoder 472 and associated entropy encoder 474 compress audio data for the mixed/pure lossless coding mode. The encoder 400 uses the mixed/pure lossless coding mode for an entire sequence or switches between coding modes on a frame-by-frame, block-by-block, tile-by-tile, or other basis.

The MUX 490 multiplexes the side information received from the other modules of the audio encoder 400 along with the entropy encoded data received from the entropy encoders 470, 474. The MUX 490 includes one or more buffers for rate control or other purposes.

D. Second Audio Decoder

With reference to FIG. 5, the second audio decoder 500 receives a bitstream 505 of compressed audio information. The bitstream 505 includes entropy encoded data as well as side information from which the decoder 500 reconstructs audio samples 595.

The DEMUX 510 parses information in the bitstream 505 and sends information to the modules of the decoder 500. The DEMUX 510 includes one or more buffers to compensate for short-term variations in bitrate due to fluctuations in complexity of the audio, network jitter, and/or other factors.

The entropy decoder 520 losslessly decompresses entropy codes received from the DEMUX 510, typically applying the inverse of the entropy encoding techniques used in the encoder 400. When decoding data compressed in lossy coding mode, the entropy decoder 520 produces quantized spectral coefficient data.

The mixed/pure lossless decoder 522 and associated entropy decoder(s) 520 decompress losslessly encoded audio data for the mixed/pure lossless coding mode.

The tile configuration decoder 530 receives and, if necessary, decodes information indicating the patterns of tiles for frames from the DEMUX 590. The tile pattern information may be entropy encoded or otherwise parameterized. The tile configuration decoder 530 then passes tile pattern information to various other modules of the decoder 500.

The inverse multi-channel transformer 540 receives the quantized spectral coefficient data from the entropy decoder 520 as well as tile pattern information from the tile configuration decoder 530 and side information from the DEMUX 510 indicating, for example, the multi-channel transform used and transformed parts of tiles. Using this information, the inverse multi-channel transformer 540 decompresses the transform matrix as necessary, and selectively and flexibly applies one or more inverse multi-channel transforms to the audio data.

The inverse quantizer/weighter 550 receives information such as tile and channel quantization factors as well as quantization matrices from the DEMUX 510 and receives quantized spectral coefficient data from the inverse multi-channel transformer 540. The inverse quantizer/weighter 550 decompresses the received weighting factor information as necessary. The quantizer/weighter 550 then performs the inverse quantization and weighting.

The inverse frequency transformer 560 receives the spectral coefficient data output by the inverse quantizer/weighter 550 as well as side information from the DEMUX 510 and tile pattern information from the tile configuration decoder 530. The inverse frequency transformer 570 applies the inverse of the frequency transform used in the encoder and outputs blocks to the overlapper/adder 570.

In addition to receiving tile pattern information from the tile configuration decoder 530, the overlapper/adder 570 receives decoded information from the inverse frequency transformer 560 and/or mixed/pure lossless decoder 522. The overlapper/adder 570 overlaps and adds audio data as necessary and interleaves frames or other sequences of audio data encoded with different modes.

The multi-channel post-processor 580 optionally re-matrixes the time-domain audio samples output by the overlapper/adder 570. For bitstream-controlled post-processing, the post-processing transform matrices vary over time and are signaled or included in the bitstream 505.

III. Overview of Multi-Channel Processing

This section is an overview of some multi-channel processing techniques used in some encoders and decoders, including multi-channel pre-processing techniques, flexible multi-channel transform techniques, and multi-channel post-processing techniques.

A. Multi-Channel Pre-Processing

Some encoders perform multi-channel pre-processing on input audio samples in the time domain.

In traditional encoders, when there are N source audio channels as input, the number of output channels produced by the encoder is also N. The number of coded channels may correspond one-to-one with the source channels, or the coded channels may be multi-channel transform-coded channels. When the coding complexity of the source makes compression difficult or when the encoder buffer is full, however, the encoder may alter or drop (i.e., not code) one or more of the original input audio channels or multi-channel transform-coded channels. This can be done to reduce coding complexity and improve the overall perceived quality of the audio. For quality-driven pre-processing, an encoder may perform multi-channel pre-processing in reaction to measured audio quality so as to smoothly control overall audio quality and/or channel separation.

For example, an encoder may alter a multi-channel audio image to make one or more channels less critical so that the channels are dropped at the encoder yet reconstructed at a decoder as "virtual" or uncoded channels. This helps to avoid the need for outright deletion of channels or severe quantization, which can have a dramatic effect on quality.

An encoder can indicate to the decoder what action to take when the number of coded channels is less than the number of channels for output. Then, a multi-channel post-processing transform can be used in a decoder to create virtual channels. For example, an encoder (through a bitstream) can instruct a decoder to create a virtual center by averaging decoded left and right channels. Later multi-channel transformations may exploit redundancy between averaged back left and back right channels (without post-processing), or an encoder may instruct a decoder to perform some multi-channel post-processing for back left and right channels. Or, an encoder can signal to a decoder to perform multi-channel post-processing for another purpose.

Figure 7:
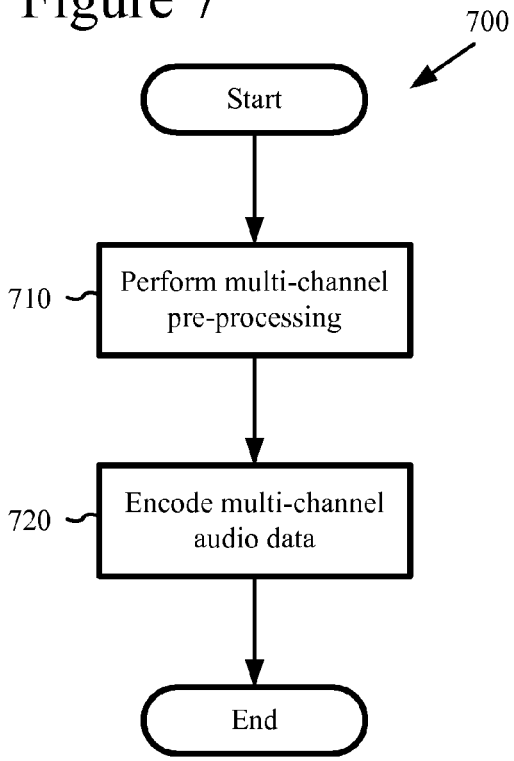
FIG. 7 is a flow chart showing a generalized technique for multi-channel pre-processing.

FIG. 7 shows a generalized technique 700 for multi-channel pre-processing. An encoder performs (710) multi-channel pre-processing on time-domain multi-channel audio data, producing transformed audio data in the time domain. For example, the pre-processing involves a general transform matrix with real, continuous valued elements. The general transform matrix can be chosen to artificially increase inter-channel correlation. This reduces complexity for the rest of the encoder, but at the cost of lost channel separation.

The output is then fed to the rest of the encoder, which, in addition to any other processing that the encoder may perform, encodes (720) the data using techniques described with reference to FIG. 4 or other compression techniques, producing encoded multi-channel audio data.

A syntax used by an encoder and decoder may allow description of general or pre-defined post-processing multi-channel transform matrices, which can vary or be turned on/off on a frame-to-frame basis. An encoder can use this flexibility to limit stereo/surround image impairments, trading off channel separation for better overall quality in certain circumstances by artificially increasing inter-channel correlation. Alternatively, a decoder and encoder can use another syntax for multi-channel pre- and post-processing, for example, one that allows changes in transform matrices on a basis other than frame-to-frame.

B. Flexible Multi-Channel Transforms

Some encoders can perform flexible multi-channel transforms that effectively take advantage of inter-channel correlation. Corresponding decoders can perform corresponding inverse multi-channel transforms.

For example, an encoder can position a multi-channel transform after perceptual weighting (and the decoder can position the inverse multi-channel transform before inverse weighting) such that a cross-channel leaked signal is controlled, measurable, and has a spectrum like the original signal. An encoder can apply weighting factors to multi-channel audio in the frequency domain (e.g., both weighting factors and per-channel quantization step modifiers) before multi-channel transforms. An encoder can perform one or more multi-channel transforms on weighted audio data, and quantize multi-channel transformed audio data.

A decoder can collect samples from multiple channels at a particular frequency index into a vector and perform an inverse multi-channel transform to generate the output. Subsequently, a decoder can inverse quantize and inverse weight the multi-channel audio, coloring the output of the inverse multi-channel transform with mask(s). Thus, leakage that occurs across channels (due to quantization) can be spectrally shaped so that the leaked signal's audibility is measurable and controllable, and the leakage of other channels in a given reconstructed channel is spectrally shaped like the original uncorrupted signal of the given channel.

An encoder can group channels for multi-channel transforms to limit which channels get transformed together. For example, an encoder can determine which channels within a tile correlate and group the correlated channels. An encoder can consider pair-wise correlations between signals of channels as well as correlations between bands, or other and/or additional factors when grouping channels for multi-channel transformation. For example, an encoder can compute pair-wise correlations between signals in channels and then group channels accordingly. A channel that is not pair-wise correlated with any of the channels in a group may still be compatible with that group. For channels that are incompatible with a group, an encoder can check compatibility at band level and adjust one or more groups of channels accordingly. An encoder can identify channels that are compatible with a group in some bands, but incompatible in some other bands. Turning off a transform at incompatible bands can improve correlation among bands that actually get multi-channel transform coded and improve coding efficiency. Channels in a channel group need not be contiguous. A single tile may include multiple channel groups, and each channel group may have a different associated multi-channel transform. After deciding which channels are compatible, an encoder can put channel group information into a bitstream. A decoder can then retrieve and process the information from the bitstream.

An encoder can selectively turn multi-channel transforms on or off at the frequency band level to control which bands are transformed together. In this way, an encoder can selectively exclude bands that are not compatible in multi-channel transforms. When a multi-channel transform is turned off for a particular band, an encoder can use the identity transform for that band, passing through the data at that band without altering it. The number of frequency bands relates to the sampling frequency of the audio data and the tile size. In general, the higher the sampling frequency or larger the tile size, the greater the number of frequency bands. An encoder can selectively turn multi-channel transforms on or off at the frequency band level for channels of a channel group of a tile. A decoder can retrieve band on/off information for a multi-channel transform for a channel group of a tile from a bitstream according to a particular bitstream syntax.

An encoder can use hierarchical multi-channel transforms to limit computational complexity, especially in the decoder. With a hierarchical transform, an encoder can split an overall transformation into multiple stages, reducing the computational complexity of individual stages and in some cases reducing the amount of information needed to specify multi-channel transforms. Using this cascaded structure, an encoder can emulate the larger overall transform with smaller transforms, up to some accuracy. A decoder can then perform a corresponding hierarchical inverse transform. An encoder may combine frequency band on/off information for the multiple multi-channel transforms. A decoder can retrieve information for a hierarchy of multi-channel transforms for channel groups from a bitstream according to a particular bitstream syntax.

An encoder can use pre-defined multi-channel transform matrices to reduce the bitrate used to specify transform matrices. An encoder can select from among multiple available pre-defined matrix types and signal the selected matrix in the bitstream. Some types of matrices may require no additional signaling in the bitstream. Others may require additional specification. A decoder can retrieve the information indicating the matrix type and (if necessary) the additional information specifying the matrix.

An encoder can compute and apply quantization matrices for channels of tiles, per-channel quantization step modifiers, and overall quantization tile factors. This allows an encoder to shape noise according to an auditory model, balance noise between channels, and control overall distortion. A corresponding decoder can decode apply overall quantization tile factors, per-channel quantization step modifiers, and quantization matrices for channels of tiles, and can combine inverse quantization and inverse weighting steps C. Multi-Channel Post-Processing Some decoders perform multi-channel post-processing on reconstructed audio samples in the time domain.

For example, the number of decoded channels may be less than the number of channels for output (e.g., because the encoder did not code one or more input channels). If so, a multi-channel post-processing transform can be used to create one or more "virtual" channels based on actual data in the decoded channels. If the number of decoded channels equals the number of output channels, the post-processing transform can be used for arbitrary spatial rotation of the presentation, remapping of output channels between speaker positions, or other spatial or special effects. If the number of decoded channels is greater than the number of output channels (e.g., playing surround sound audio on stereo equipment), a post-processing transform can be used to "fold-down" channels. Transform matrices for these scenarios and applications can be provided or signaled by the encoder.

Figure 8:
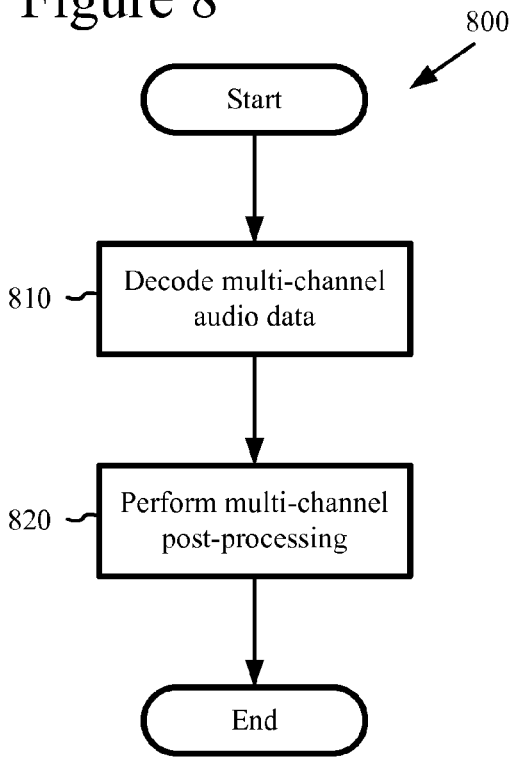
FIG. 8 is a flow chart showing a generalized technique for multi-channel post-processing.

FIG. 8 shows a generalized technique 800 for multi-channel post-processing. The decoder decodes (810) encoded multi-channel audio data, producing reconstructed time-domain multi-channel audio data.

The decoder then performs (820) multi-channel post-processing on the time-domain multi-channel audio data. When the encoder produces a number of coded channels and the decoder outputs a larger number of channels, the post-processing involves a general transform to produce the larger number of output channels from the smaller number of coded channels. For example, the decoder takes co-located (in time) samples, one from each of the reconstructed coded channels, then pads any channels that are missing (i.e., the channels dropped by the encoder) with zeros. The decoder multiplies the samples with a general post-processing transform matrix.

The general post-processing transform matrix can be a matrix with pre-determined elements, or it can be a general matrix with elements specified by the encoder. The encoder signals the decoder to use a pre-determined matrix (e.g., with one or more flag bits) or sends the elements of a general matrix to the decoder, or the decoder may be configured to always use the same general post-processing transform matrix. For additional flexibility, the multi-channel post-processing can be turned on/off on a frame-by-frame or other basis (in which case, the decoder may use an identity matrix to leave channels unaltered).

IV. Channel Extension Processing for Multi-Channel Audio

In a typical coding scheme for coding a multi-channel source, a time-to-frequency transformation using a transform such as a modulated lapped transform ("MLT") or discrete cosine transform ("DCT") is performed at an encoder, with a corresponding inverse transform at the decoder. MLT or DCT coefficients for some of the channels are grouped together into a channel group and a linear transform is applied across the channels to obtain the channels that are to be coded. If the left and right channels of a stereo source are correlated, they can be coded using a sum-difference transform (also called M/S or mid/side coding). This removes correlation between the two channels, resulting in fewer bits needed to code them. However, at low bitrates, the difference channel may not be coded (resulting in loss of stereo image), or quality may suffer from heavy quantization of both channels.

Instead of coding sum and difference channels for channel groups (e.g., left/right pairs, front left/front right pairs, back left/back right pairs, or other groups), a desirable alternative to these typical joint coding schemes (e.g., mid/side coding, intensity stereo coding, etc.) is to code one or more combined channels (which may be sums of channels, a principal major component after applying a de-correlating transform, or some other combined channel) along with additional parameters to describe the cross-channel correlation and power of the respective physical channels and allow reconstruction of the physical channels that maintains the cross-channel correlation and power of the respective physical channels. In other words, second order statistics of the physical channels are maintained. Such processing can be referred to as channel extension processing.

For example, using complex transforms allows channel reconstruction that maintains cross-channel correlation and power of the respective channels. For a narrowband signal approximation, maintaining second-order statistics is sufficient to provide a reconstruction that maintains the power and phase of individual channels, without sending explicit correlation coefficient information or phase information.

The channel extension processing represents uncoded channels as modified versions of coded channels. Channels to be coded can be actual, physical channels or transformed versions of physical channels (using, for example, a linear transform applied to each sample). For example, the channel extension processing allows reconstruction of plural physical channels using one coded channel and plural parameters. In one implementation, the parameters include ratios of power (also referred to as intensity or energy) between two physical channels and a coded channel on a per-band basis. For example, to code a signal having left (L) and right (R) stereo channels, the power ratios are L/M and R/M, where M is the power of the coded channel (the "sum" or "mono" channel), L is the power of left channel, and R is the power of the right channel. Although channel extension coding can be used for all frequency ranges, this is not required. For example, for lower frequencies an encoder can code both channels of a channel transform (e.g., using sum and difference), while for higher frequencies an encoder can code the sum channel and plural parameters.

The channel extension processing can significantly reduce the bitrate needed to code a multi-channel source. The parameters for modifying the channels take up a small portion of the total bitrate, leaving more bitrate for coding combined channels. For example, for a two channel source, if coding the parameters takes 10% of the available bitrate, 90% of the bits can be used to code the combined channel. In many cases, this is a significant savings over coding both channels, even after accounting for cross-channel dependencies.

Channels can be reconstructed at a reconstructed channel/coded channel ratio other than the 2:1 ratio described above. For example, a decoder can reconstruct left and right channels and a center channel from a single coded channel. Other arrangements also are possible. Further, the parameters can be defined different ways. For example, the parameters may be defined on some basis other than a per-band basis.

A. Complex Transforms and Scale/Shape Parameters

In one prior approach to channel extension processing, an encoder forms a combined channel and provides parameters to a decoder for reconstruction of the channels that were used to form the combined channel. A decoder derives complex spectral coefficients (each having a real component and an imaginary component) for the combined channel using a forward complex time-frequency transform. Then, to reconstruct physical channels from the combined channel, the decoder scales the complex coefficients using the parameters provided by the encoder. For example, the decoder derives scale factors from the parameters provided by the encoder and uses them to scale the complex coefficients. The combined channel is often a sum channel (sometimes referred to as a mono channel) but also may be another combination of physical channels. The combined channel may be a difference channel (e.g., the difference between left and right channels) in cases where physical channels are out of phase and summing the channels would cause them to cancel each other out.

For example, the encoder sends a sum channel for left and right physical channels and plural parameters to a decoder which may include one or more complex parameters. (Complex parameters are derived in some way from one or more complex numbers, although a complex parameter sent by an encoder (e.g., a ratio that involves an imaginary number and a real number) may not itself be a complex number.) The encoder also may send only real parameters from which the decoder can derive complex scale factors for scaling spectral coefficients. (The encoder typically does not use a complex transform to encode the combined channel itself. Instead, the encoder can use any of several encoding techniques to encode the combined channel.)

Figure 9:
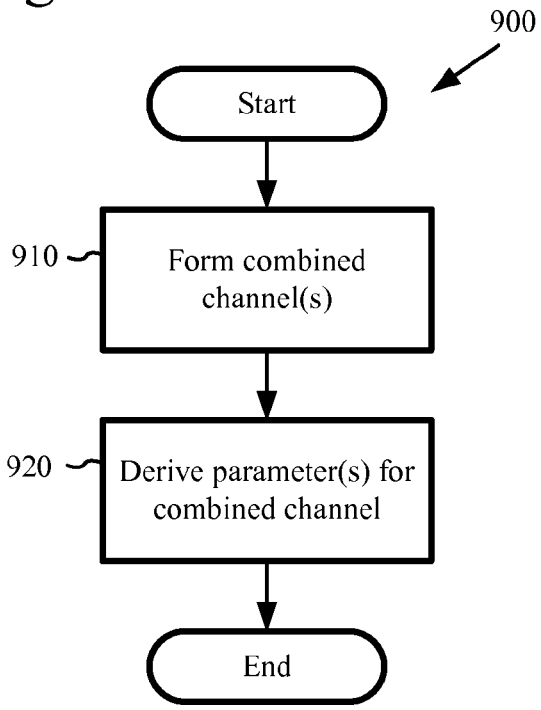
FIG. 9 is a flow chart showing a technique for deriving complex scale factors for combined channels in channel extension encoding.
Figure 10:
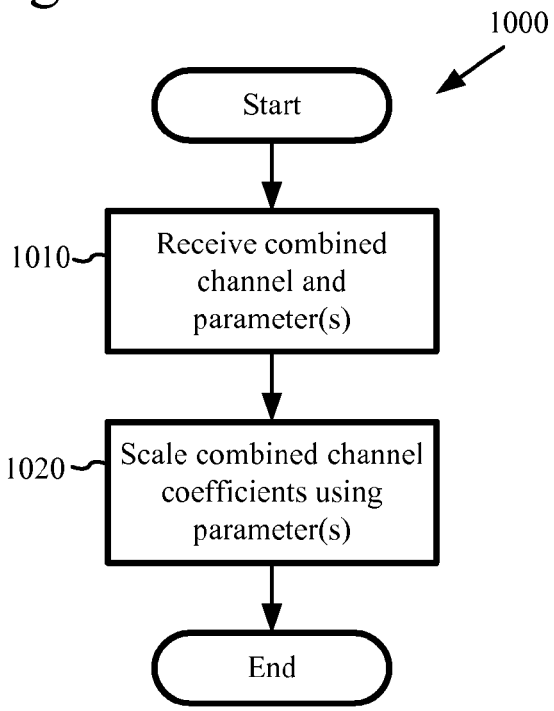
FIG. 10 is a flow chart showing a technique for using complex scale factors in channel extension decoding.

FIG. 9 shows a simplified channel extension coding technique 900 performed by an encoder. At 910, the encoder forms one or more combined channels (e.g., sum channels). Then, at 920, the encoder derives one or more parameters to be sent along with the combined channel to a decoder. FIG. 10 shows a simplified inverse channel extension decoding technique 1000 performed by a decoder. At 1010, the decoder receives one or more parameters for one or more combined channels. Then, at 1020, the decoder scales combined channel coefficients using the parameters. For example, the decoder derives complex scale factors from the parameters and uses the scale factors to scale the coefficients.

After a time-to-frequency transform at an encoder, the spectrum of each channel is usually divided into sub-bands. In the channel extension coding technique, an encoder can determine different parameters for different frequency sub-bands, and a decoder can scale coefficients in a band of the combined channel for the respective band in the reconstructed channel using one or more parameters provided by the encoder. In a coding arrangement where left and right channels are to be reconstructed from one coded channel, each coefficient in the sub-band for each of the left and right channels is represented by a scaled version of a sub-band in the coded channel.

Figure 11:
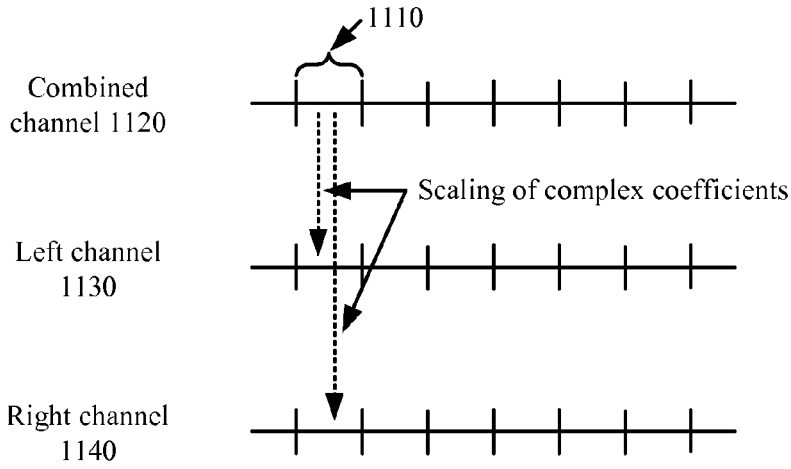
FIG. 11 is a diagram showing scaling of combined channel coefficients in channel reconstruction.

For example, FIG. 11 shows scaling of coefficients in a band 1110 of a combined channel 1120 during channel reconstruction. The decoder uses one or more parameters provided by the encoder to derive scaled coefficients in corresponding sub-bands for the left channel 1230 and the right channel 1240 being reconstructed by the decoder.

In one implementation, each sub-band in each of the left and right channels has a scale parameter and a shape parameter. The shape parameter may be determined by the encoder and sent to the decoder, or the shape parameter may be assumed by taking spectral coefficients in the same location as those being coded. The encoder represents all the frequencies in one channel using scaled version of the spectrum from one or more of the coded channels. A complex transform (having a real number component and an imaginary number component) is used, so that cross-channel second-order statistics of the channels can be maintained for each sub-band. Because coded channels are a linear transform of actual channels, parameters do not need to be sent for all channels. For example, if P channels are coded using N channels (where $N<P$), then parameters do not need to be sent for all P channels. More information on scale and shape parameters is provided below in Section V.

The parameters may change over time as the power ratios between the physical channels and the combined channel change. Accordingly, the parameters for the frequency bands in a frame may be determined on a frame by frame basis or some other basis. The parameters for a current band in a current frame are differentially coded based on parameters from other frequency bands and/or other frames in described embodiments.

The decoder performs a forward complex transform to derive the complex spectral coefficients of the combined channel. It then uses the parameters sent in the bitstream (such as power ratios and an imaginary-to-real ratio for the cross-correlation or a normalized correlation matrix) to scale the spectral coefficients. The output of the complex scaling is sent to the post processing filter. The output of this filter is scaled and added to reconstruct the physical channels.

Channel extension coding need not be performed for all frequency bands or for all time blocks. For example, channel extension coding can be adaptively switched on or off on a per band basis, a per block basis, or some other basis. In this way, an encoder can choose to perform this processing when it is efficient or otherwise beneficial to do so. The remaining bands or blocks can be processed by traditional channel decorrelation, without decorrelation, or using other methods.

The achievable complex scale factors in described embodiments are limited to values within certain bounds. For example, described embodiments encode parameters in the log domain, and the values are bound by the amount of possible cross-correlation between channels.

The channels that can be reconstructed from the combined channel using complex transforms are not limited to left and right channel pairs, nor are combined channels limited to combinations of left and right channels. For example, combined channels may represent two, three or more physical channels. The channels reconstructed from combined channels may be groups such as back-left/back-right, back-left/left, back-right/right, left/center, right/center, and left/center/right. Other groups also are possible. The reconstructed channels may all be reconstructed using complex transforms, or some channels may be reconstructed using complex transforms while others are not.

B. Interpolation of Parameters

An encoder can choose anchor points at which to determine explicit parameters and interpolate parameters between the anchor points. The amount of time between anchor points and the number of anchor points may be fixed or vary depending on content and/or encoder-side decisions. When an anchor point is selected at time t, the encoder can use that anchor point for all frequency bands in the spectrum. Alternatively, the encoder can select anchor points at different times for different frequency bands.

Figure 12:
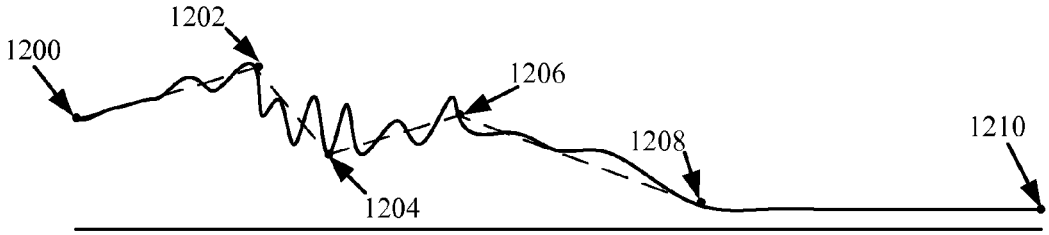
FIG. 12 is a chart showing a graphical comparison of actual power ratios and power ratios interpolated from power ratios at anchor points.

FIG. 12 is a graphical comparison of actual power ratios and power ratios interpolated from power ratios at anchor points. In the example shown in FIG. 12, interpolation smoothes variations in power ratios (e.g., between anchor points 1200 and 1202, 1202 and 1204, 1204 and 1206, and 1206 and 1208) which can help to avoid artifacts from frequently-changing power ratios. The encoder can turn interpolation on or off or not interpolate the parameters at all. For example, the encoder can choose to interpolate parameters when changes in the power ratios are gradual over time, or turn off interpolation when parameters are not changing very much from frame to frame (e.g., between anchor points 1208 and 1210 in FIG. 12), or when parameters are changing so rapidly that interpolation would provide inaccurate representation of the parameters.

C. Detailed Explanation

A general linear channel transform can be written as Y=AX, where X is a set of L vectors of coefficients from P channels (a P×L dimensional matrix), A is a P×P channel transform matrix, and Y is the set of L transformed vectors from the P channels that are to be coded (a P×L dimensional matrix). L (the vector dimension) is the band size for a given subframe on which the linear channel transform algorithm operates. If an encoder codes a subset N of the P channels in Y, this can be expressed as Z=BX, where the vector Z is an N×L matrix, and B is a N×P matrix formed by taking N rows of matrix Y corresponding to the N channels which are to be coded. Reconstruction from the N channels involves another matrix multiplication with a matrix C after coding the vector Z to obtain W=CQ(Z), where Q represents quantization of the vector Z. Substituting for Z gives the equation W=CQ(BX). Assuming quantization noise is negligible, W=CBX. C can be appropriately chosen to maintain cross-channel second-order statistics between the vector X and W. In equation form, this can be represented as WW*=CBXX*B*C*=XX*, where XX* is a symmetric P×P matrix.

Since XX* is a symmetric P×P matrix, there are P(P+1)/2 degrees of freedom in the matrix. If N>=(P+1)/2, then it may be possible to come up with a P×N matrix C such that the equation is satisfied. If N<(P+1)/2, then more information is needed to solve this. If that is the case, complex transforms can be used to come up with other solutions which satisfy some portion of the constraint.

For example, if X is a complex vector and C is a complex matrix, we can try to find C such that Re(CBXX*B*C*)=Re(XX*). According to this equation, for an appropriate complex matrix C the real portion of the symmetric matrix XX* is equal to the real portion of the symmetric matrix product CBXX*B*C*.

Example 1

For the case where M=2 and N=1, then, BXX*B* is simply a real scalar (L×1) matrix, referred to as $\alpha$. We solve for the equations shown in FIG. 13. If $B_0=B_1=\beta$ (which is some constant) then the constraint in FIG. 14 holds. Solving, we get the values shown in FIG. 15 for $|C_0|$, $|C_1|$ and $|C_0||C_1|\cos(\phi_0-\phi_1)$. The encoder sends $|C_0|$ and $|C_1|$. Then we can solve using the constraint shown in FIG. 16. It should be clear from FIG. 15 that these quantities are essentially the power ratios L/M and R/M. The sign in the constraint shown in FIG. 16 can be used to control the sign of the phase so that it matches the imaginary portion of XX*. This allows solving for $\phi_0-\phi_1$, but not for the actual values. In order for to solve for the exact values, another assumption is made that the angle of the mono channel for each coefficient is maintained, as expressed in FIG. 17. To maintain this, it is sufficient that $|C_0|\sin\phi_0+|C_1|\sin\phi_1=0$, which gives the results for $\phi_0$ and $\phi_1$ shown in FIG. 18.

Using the constraint shown in FIG. 16, we can solve for the real and imaginary portions of the two scale factors. For example, the real portion of the two scale factors can be found by solving for $|C_0|\cos\phi_0$ and $|C_1|\cos\phi_1$, respectively, as shown in FIG. 19. The imaginary portion of the two scale factors can be found by solving for $|C_0|\sin\phi_0$ and $|C_1|\sin\phi_1$, respectively, as shown in FIG. 20.

Thus, when the encoder sends the magnitude of the complex scale factors, the decoder is able to reconstruct two individual channels which maintain cross-channel second order characteristics of the original, physical channels, and the two reconstructed channels maintain the proper phase of the coded channel.

Example 2

In Example 1, although the imaginary portion of the cross-channel second-order statistics is solved for (as shown in FIG. 20), only the real portion is maintained at the decoder, which is only reconstructing from a single mono source. However, the imaginary portion of the cross-channel second-order statistics also can be maintained if (in addition to the complex scaling) the output from the previous stage as described in Example 1 is post-processed to achieve an additional spatialization effect. The output is filtered through a linear filter, scaled, and added back to the output from the previous stage.

Suppose that in addition to the current signal from the previous analysis ($W_0$ and $W_1$ for the two channels, respectively), the decoder has the effect signal—a processed version of both the channels available ($W_{0F}$ and $W_{1F}$, respectively), as shown in FIG. 21. Then the overall transform can be represented as shown in FIG. 23, which assumes that $W_{0F}=C_0Z_{0F}$ and $W_{1F}=C_1Z_{0F}$. We show that by following the reconstruction procedure shown in FIG. 22 the decoder can maintain the second-order statistics of the original signal. The decoder takes a linear combination of the original and filtered versions of W to create a signal S which maintains the second-order statistics of X.

In Example 1, it was determined that the complex constants $C_0$ and $C_1$ can be chosen to match the real portion of the cross-channel second-order statistics by sending two parameters (e.g., left-to-mono (L/M) and right-to-mono (R/M) power ratios). If another parameter is sent by the encoder, then the entire cross-channel second-order statistics of a multi-channel source can be maintained.

For example, the encoder can send an additional, complex parameter that represents the imaginary-to-real ratio of the cross-correlation between the two channels to maintain the entire cross-channel second-order statistics of a two-channel source. Suppose that the correlation matrix is given by $R_{XX}$, as defined in FIG. 24, where U is an orthonormal matrix of complex Eigenvectors, and Λ is a diagonal matrix of Eigenvalues. Note that this factorization must exist for any symmetric matrix. For any achievable power correlation matrix, the Eigenvalues must also be real. This factorization allows us to find a complex Karhunen-Loeve Transform ("KLT"). A KLT has been used to create de-correlated sources for compression. Here, we wish to do the reverse operation which is take uncorrelated sources and create a desired correlation. The KLT of vector X is given by U*, since $U^*U\Lambda U^*U=\Lambda$, a diagonal matrix. The power in Z is α. Therefore if we choose a transform such as $$U\left(\frac{\Lambda}{\alpha}\right)^{1/2}=\begin{bmatrix} aC_0 & bC_0 \\ cC_1 & dC_1 \end{bmatrix},$$

and assume $W_{0F}$ and $W_{1F}$ have the same power as and are uncorrelated to $W_0$ and $W_1$ respectively, the reconstruction procedure in FIG. 23 or 22 produces the desired correlation matrix for the final output. In practice, the encoder sends power ratios $|C_0|$ and $|C_1|$, and the imaginary-to-real ratio $\mathrm{Im}(X_0X^*_1)/\alpha$. The decoder can reconstruct a normalized version of the cross correlation matrix (as shown in FIG. 25). The decoder can then calculate θ and find Eigenvalues and Eigenvectors, arriving at the desired transform.

Due to the relationship between $|C_0|$ and $|C_1|$, they cannot possess independent values. Hence, the encoder quantizes them jointly or conditionally. This applies to both Examples 1 and 2.

Other parameterizations are also possible, such as by sending from the encoder to the decoder a normalized version of the power matrix directly where we can normalize by the geometric mean of the powers, as shown in FIG. 26. Now the encoder can send just the first row of the matrix, which is sufficient since the product of the diagonals is 1. However, now the decoder scales the Eigenvalues as shown in FIG. 27.

Another parameterization is possible to represent U and Λ directly. It can be shown that U can be factorized into a series of Givens rotations. Each Givens rotation can be represented by an angle. The encoder transmits the Givens rotation angles and the Eigenvalues.

Also, both parameterizations can incorporate any additional arbitrary pre-rotation V and still produce the same correlation matrix since $VV^*=I$, where I stands for the identity matrix. That is, the relationship shown in FIG. 28 will work for any arbitrary rotation V. For example, the decoder chooses a pre-rotation such that the amount of filtered signal going into each channel is the same, as represented in FIG. 29. The decoder can choose ω such that the relationships in FIG. 30 hold.

Once the matrix shown in FIG. 31 is known, the decoder can do the reconstruction as before to obtain the channels $W_0$ and $W_1$. Then the decoder obtains $W_{0F}$ and $W_{1F}$ (the effect signals) by applying a linear filter to $W_0$ and $W_1$. For example, the decoder uses an all-pass filter and can take the output at any of the taps of the filter to obtain the effect signals. (For more information on uses of all-pass filters, see M. R. Schroeder and B. F. Logan, "Colorless' Artificial Reverberation," 12*th Ann. Meeting of the Audio Eng'g Soc.,* 18 pp. (1960).) The strength of the signal that is added as a post process is given in the matrix shown in FIG. 31.

The all-pass filter can be represented as a cascade of other all-pass filters. Depending on the amount of reverberation needed to accurately model the source, the output from any of the all-pass filters can be taken. This parameter can also be sent on either a band, subframe, or source basis. For example, the output of the first, second, or third stage in the all-pass filter cascade can be taken.

By taking the output of the filter, scaling it and adding it back to the original reconstruction, the decoder is able to maintain the cross-channel second-order statistics. Although the analysis makes certain assumptions on the power and the correlation structure on the effect signal, such assumptions are not always perfectly met in practice. Further processing and better approximation can be used to refine these assumptions. For example, if the filtered signals have a power which is larger than desired, the filtered signal can be scaled as shown in FIG. 32 so that it has the correct power. This ensures that the power is correctly maintained if the power is too large. A calculation for determining whether the power exceeds the threshold is shown in FIG. 33.

There can sometimes be cases when the signal in the two physical channels being combined is out of phase, and thus if sum coding is being used, the matrix will be singular. In such cases, the maximum norm of the matrix can be limited. This parameter (a threshold) to limit the maximum scaling of the matrix can also be sent in the bitstream on a band, subframe, or source basis.

As in Example 1, the analysis in this Example assumes that $B_0=B_1=\beta$. However, the same algebra principles can be used for any transform to obtain similar results.

V. Multi-Channel Extension Coding/Decoding with More Than Two Source Channels

The channel extension processing described above codes a multi-channel sound source by coding a subset of the channels, along with parameters from which the decoder can reproduce a normalized version of a channel correlation matrix. Using the channel correlation matrix, the decoder process reconstructs the remaining channels from the coded subset of the channels. The channel extension coding described in previous sections has its most practical application to audio systems with two source channels.

In accordance with a multi-channel extension coding/decoding technique described in this section, multi-channel extension coding techniques are described that can be practically applied to systems with more than two channels. The description presents two implementation examples: one that attempts to preserve the full correlation matrix, and a second that preserves some second order statistics of the correlation matrix.

Figure 34:
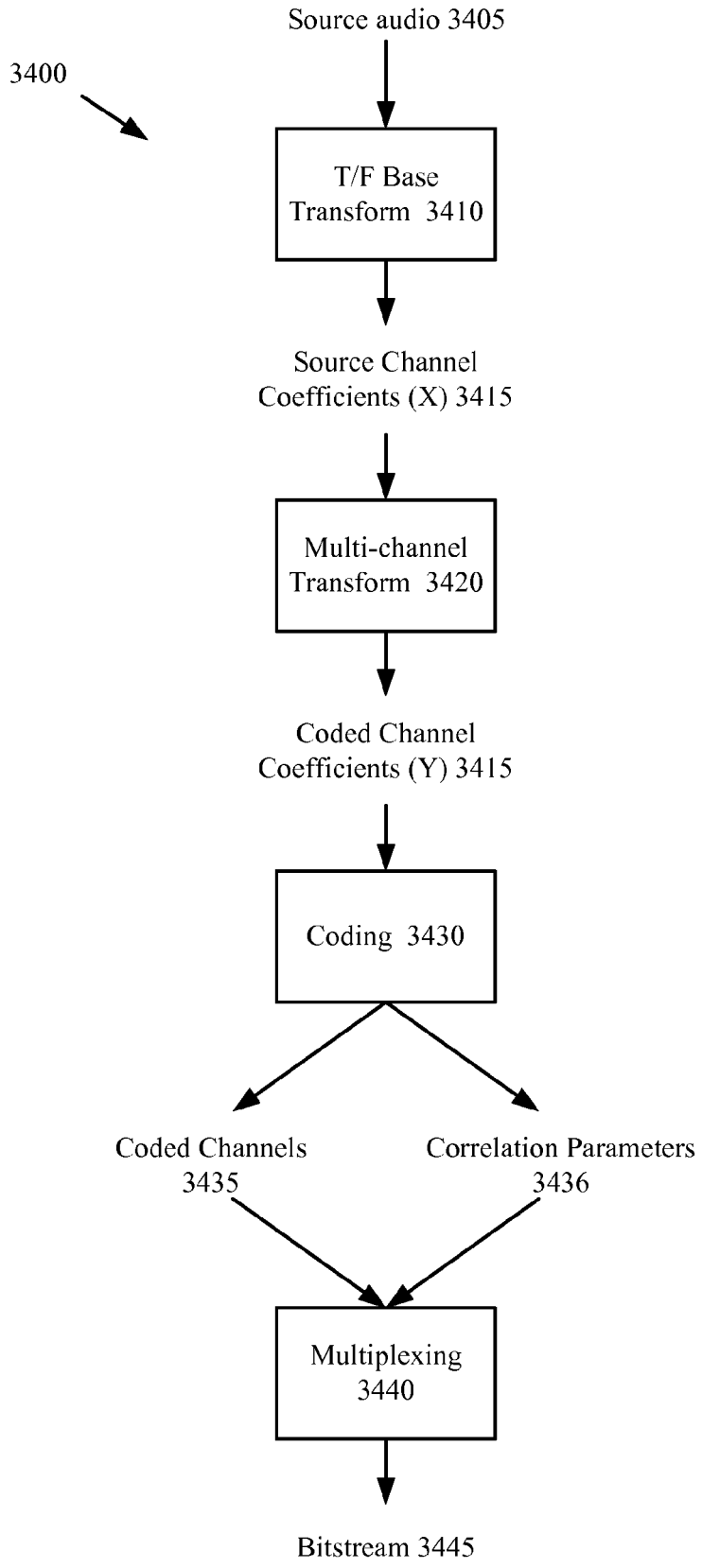
FIG. 34 is a block diagram of aspects of an encoder that performs multi-channel extension coding for a system having more than two source channels.

With reference to FIG. 34, the encoder 3400 begins encoding of the multi-channel audio source 3405 with a time to frequency domain conversion 3410 such as the MLT. In the following discussion, the output of the time to frequency conversion (MLT) is an N-dimensional vector (X) corresponding to N channels of audio. The frequency domain coefficients for the physical channels go through a linear channel transformation (A) 3420 to give the coded channel coefficients ($Y_0$, an M dimensional vector). The coded channel coefficients then have the following relationship to the source channel coefficients:

$$Y_0=AX$$

The coded channel coefficients are then coded 3430 and multiplexed 3440 with side information specifying the cross-channel correlations (correlation parameters 3436) into the bitstream 3445 that is sent to the decoder. The coding 3430 of the coefficients can optionally use the above described frequency extension coding in the coding and/or reconstruction domains and may be further coded using another channel transform matrix. The channel transform matrix A is not necessarily a square matrix. The channel transform matrix A is formed by taking the first M rows of a matrix B, which is an N×N square matrix. Thus, the components of $Y_0$ are the first M components of a vector Z, where the vector Z is related to the source channels by the matrix B, as follows.

$$Z=BX$$

The vector $Y_0$ has fewer components than X. The goal of the following multi-channel extension coding/decoding techniques is to reconstruct X in such a way that the second order statistics (such as power and cross-correlations) of X are maintained for each band of frequencies.

A. Preserving Full Correlation Matrix

In a general case implementation of the multi-channel coding technique, the encoder 3400 can send sufficient information in the correlation parameters 3436 for the decoder to construct a full power correlation matrix for each band. The channel power cross-correlation matrix generally has the form of:

$$E[XX^*]=\begin{bmatrix} E(X_0^2) & E(X_0X_1) & E(X_0X_2) & \cdots & E(X_0X_N) \\ \cdots & E(X_1^2) & E(X_1X_2) & \cdots & E(X_1X_N) \\ & \cdots & E(X_2^2) & \cdots & E(X_2X_N) \\ & & \cdots & \cdots & \cdots \\ & & & & E(X_N^2) \end{bmatrix}$$

Notice, that the components of the matrix on the upper right half above the diagonal ($E(X_0^2)$ through $E(X_N^2)$) mirror those at the bottom left half of the matrix.

Figure 35:
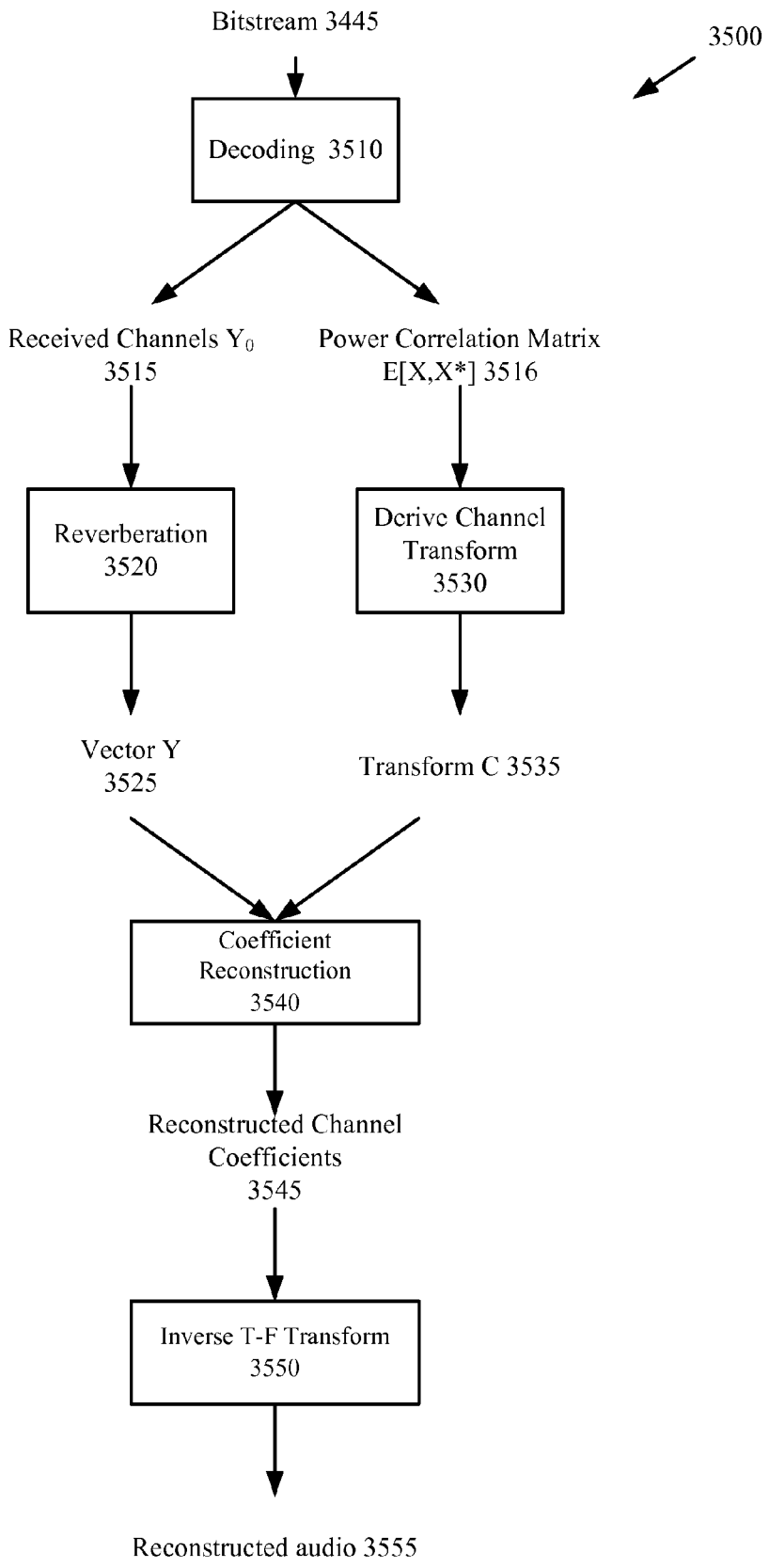
FIG. 35 is a block diagram of aspects of a general case implementation of a decoder of the multi-channel extension coding of audio by the encoder of FIG. 34, which preserves a full correlation matrix.

With reference to FIG. 35, a decoding process 3500 for the decoder in the general case implementation uses the M coded channels ($Y_0$) to create an N-dimensional vector Y 3525. The decoder forms the N−M missing components of the vector Y by creating decorrelated versions of the received coded channels $Y_0$. Such decorrelated versions can be created by many commonly known techniques, such as reverberation 3520 discussed above for the two channel audio case.

With knowledge of the correlation matrix E[XX*], the decoder forms a linear transform C 3535 using the inverse KLT of the vector Y and the forward KLT of the vector X. Using the linear transform C 3535, the decoder reconstructs 3540 the multi-channel audio (vector $\hat{X}$) from the vector Y, as per the relation $\hat{X}=CY$. When such linear transform is used for the reconstruction, then $E[XX^*]=E[\hat{X}\hat{X}^*]$, if $C=U_XD_X^{1/2}D_Y^{-1/2}U^*_Y$, where $E[XX^*]=U_XD_XU^*_X$ and $E[YY^*]=U_YD_YU^*_Y$. This factorization can be done using standard eigenvalues/eigenvector decomposition. A low power decoder can simply use the magnitude of the complex matrix C, and just use real number operations instead of complex number operations.

In this general case, the encoder 3400 therefore sends information detailing the power correlation matrix for X as the correlation parameters 3516. The decoder 3500 then computes 3530 the power correlation matrix of Y to find the linear transform C 3535 for the reconstruction 3540. If the decoder knows the linear transformations A and B, discussed above, then it can compute the correlation matrix of the vector Y by simply using the correlation matrix of the vector X because the decoder then knows that $E[Y_0Y^*_0]=AE[XX^*]A^*$. This reduces the decoder complexity for computing the correlation matrix of Y.

After the reconstruction vector $\hat{X}$ is calculated, the decoder then applies the inverse time-frequency transform 3550 on the reconstructed coefficients 3545 (vector $\hat{X}$) to reconstruct the time domain samples of the multi-channel audio 3555.

As an alternative to sending the entire correlation matrix for X as the correlation parameters 3436, the encoder 3400 (FIG. 34) can instead send the correlation matrix for the (N−M) missing components of the vector Z, together with the cross correlation matrix between the M received components of the coded vector $Y_0$ and the (N−M) missing components. That is, the encoder can send only parts of E[ZZ*] 3616, because the decoder can compute the remaining portion from the received vector $Y_0$.

Figure 36:
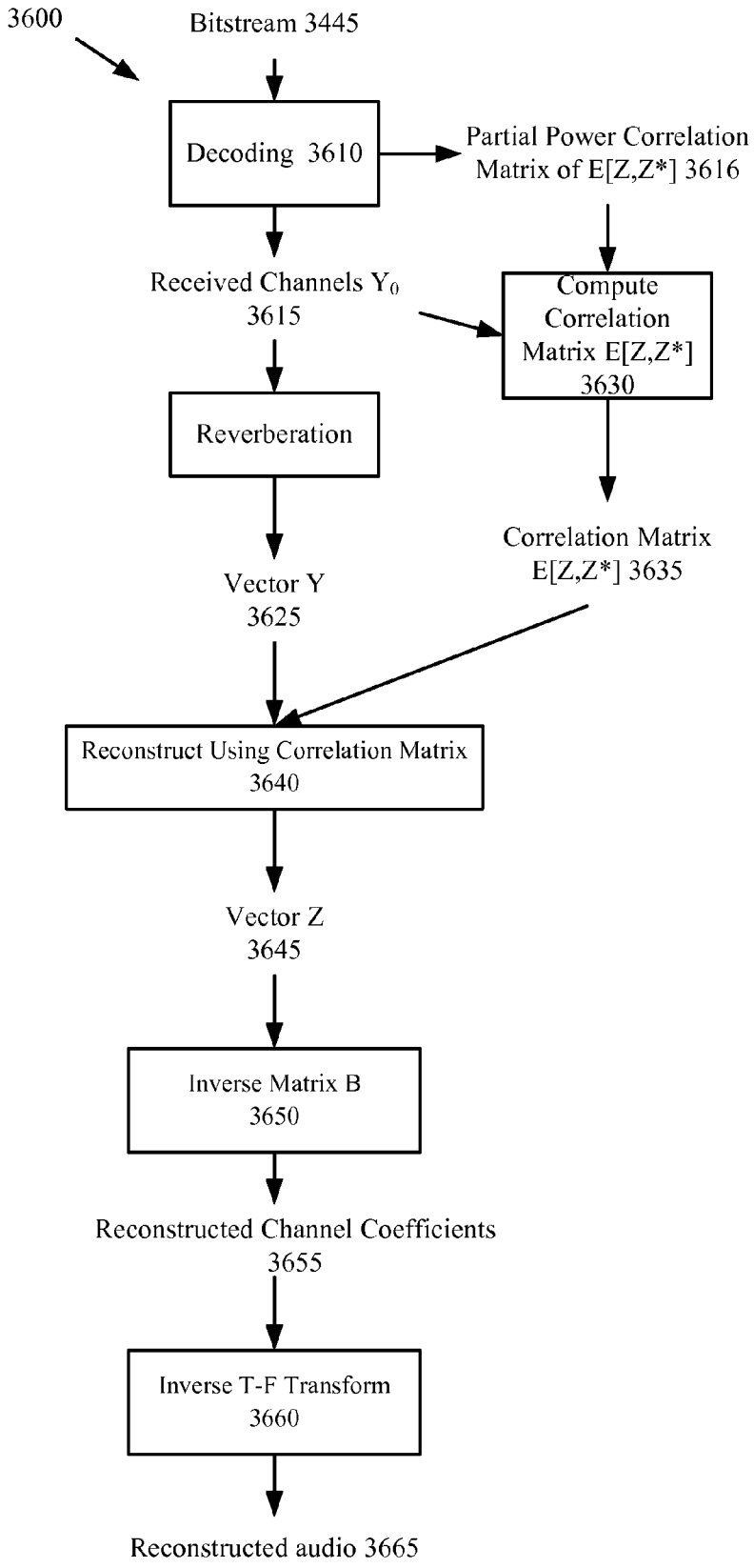
FIG. 36 is a block diagram of aspects of an alternative decoder of the multi-channel extension coding of audio by the encoder of FIG. 34.

With reference to FIG. 36, the decoder 3600 can then reconstruct 3640 the vector Z 3645 using the correlation matrix from the vector Y, and then compute the reconstructed frequency coefficients 3655 (vector $\hat{X}$) by applying the inverse matrix B 3650, as per $\hat{X}=B^{-1}\hat{Z}=B^{-1}U_ZD_Z^{1/2}D_Y^{-1/2}U^*_YY$. The decoder then uses the inverse time-frequency transform to reconstruct the multi-channel audio. This saves bitrate by not having to send the entire correlation matrix. But, the decoder needs to compute the correlation matrix for the portion of Y that is not being sent.

On the other hand, if the vector Y has a spherical power correlation matrix (cI) to begin with, then the decoder need not compute the correlation matrix. Instead, the encoder can send a normalized version of the correlation matrix for Z. The encoder just sends E[ZZ*]/c for the partial power correlation matrix 3616. It can be shown that the top left M×M quadrant of this matrix will be the identity matrix which does not need to be sent to the decoder. The decoder reconstructs 3650 the multi-channel vector ($\hat{X}$) as $\hat{X}=B^{-1}\hat{Z}=B^{-1}U_ZD_Z^{1/2}/\sqrt{c}Y$, which requires a single eigenvalues/eigenvector decomposition of the normalized correlation matrix for Z.

B. Preserving Partial Correlation Matrix

Figure 37:
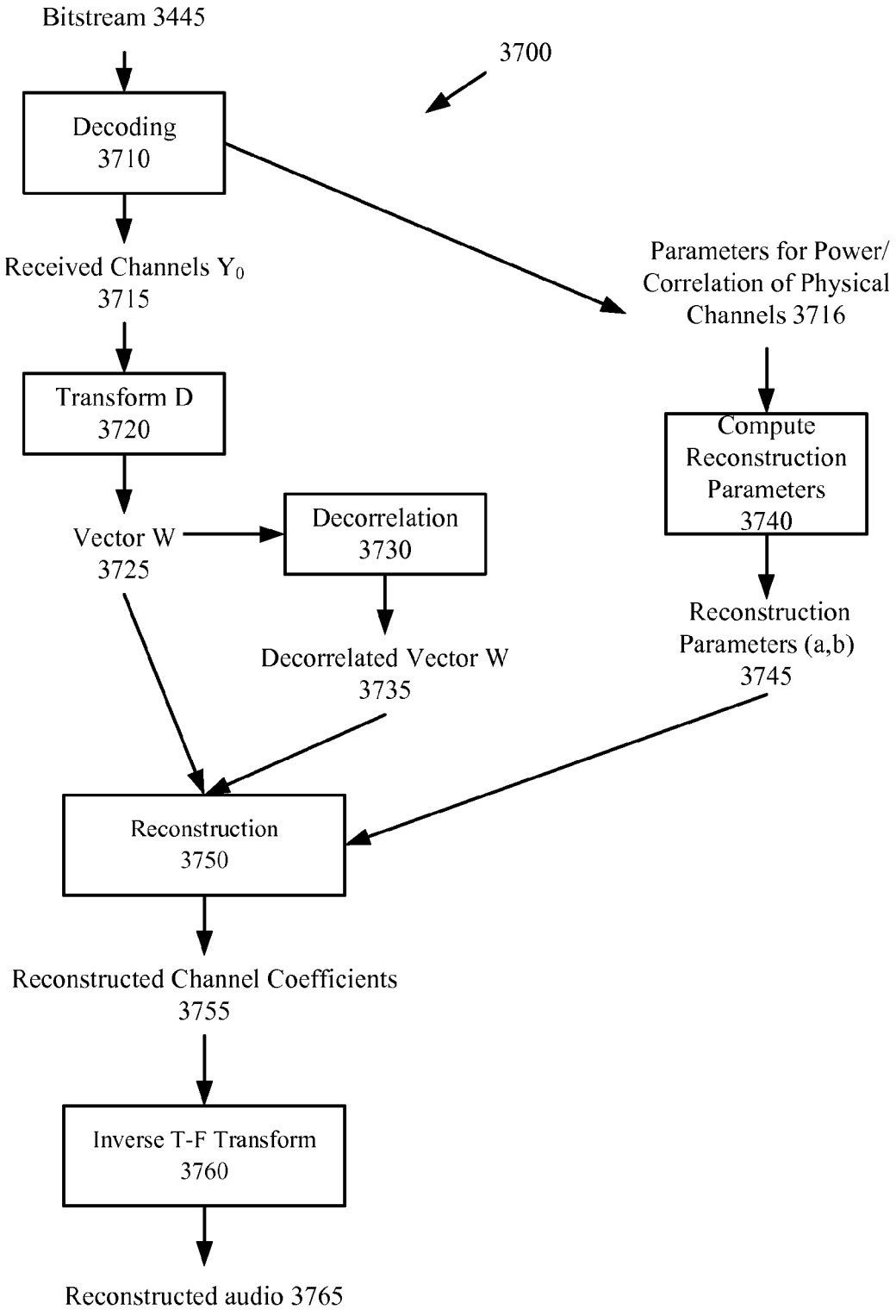
FIG. 37 is a block diagram of aspects of an alternative decoder of the multi-channel extension coding of audio by the encoder of FIG. 34, which preserves a partial correlation matrix.

Although the general case implementation shown in FIG. 35 (which sends parameters for full channel correlation matrix reconstruction) has the benefit of preserving the entire second order statistics of the vector X, the general case implementation is expensive both computationally and bit-rate wise because it requires the decoder to compute KLT/inverse KLT per band and requires sending many parameters. An alternative decoder implementation 3700 illustrated in FIG. 37 can simply choose to preserve the power in the original channels and some subset of the cross-correlations, or the cross-correlation with respect to the coded channels or some virtual channels. In other words, the alternative decoder implementation 3700 preserves a partial correlation matrix for reconstruction of the multi-channel audio from the coded channels.

Assuming that the quantization noise is small, the decoder decodes 3710 the coded channels vector $Y_0$ 3715 from the bitstream 3445, and from this constructs an N dimensional vector, W (virtual channel vector) 3725, using a linear transform D 3720 (an N×M dimensional matrix) as per the relation, W=DY, which is known to both the encoder and decoder. This transform is used to create the virtual channels from which the individual channels $\hat{X}$ are to be reconstructed. Each component of the vector X is now reconstructed using a single component of the vector W 3725 to preserve the power and the cross correlation with respect to either the corresponding component in the vector W or some other component in the vector X. The reconstruction 3750 of the ith physical channel can be done using the formula:

$$\hat{X}_i = aW_i + bW_i^{\perp},$$

where $W_i^{\perp}$ 3735 is a decorrelated 3730 version of $W_i$ (that is it has the same power as $W_i$, but is decorrelated from it). There are many ways known in the art to create such a decorrelated signal.

The decoder attempts to preserve the power of the physical channel ($E[X_iX^*_i]$) and the cross-correlation between the physical channel and the virtual channel used to reconstruct it ($E[X_iW^*_i]$). Thus, we have $$E[\hat{X}_i\hat{X}_i^*] = a^2E[W_iW_i^*] + b^2E[W_iW_i^*]$$

$$\frac{E[X_iX_i^*]}{E[W_iW_i^*]} = a^2 + b^2$$

and, $$E[\hat{X}_iW_i^*] = aE[W_iW_i^*]$$

$$\frac{E[X_iW_i^*]}{E[W_iW_i^*]} = a$$

The physical channels can be reconstructed at the decoder, if the following parameters 3716 describing the power of the physical channel and the cross-correlation between the physical channel and the coded channel are sent as additional parameters to the decoder:

$$\alpha_i = \sqrt{\frac{E[X_iX_i^*]}{E[W_iW_i^*]}}$$

$$\beta_i = \frac{E[X_iW_i^*]}{\sqrt{E[X_iX_i^*]E[W_iW_i^*]}}$$

The parameters 3745 for reconstruction can now be calculated from the received power and correlation parameters 3716 as:

$$a = \frac{E[X_iW_i^*]}{E[W_iW_i^*]} = \alpha_i\beta_i$$

and, $$a^2 + b^2 = \frac{E[X_iX_i^*]}{E[W_iW_i^*]}$$

$$b^2 = \frac{E[X_iX_i^*]}{E[W_iW_i^*]} - a^2$$

$$|b| = \alpha_i\sqrt{1 - |\beta_i|^2}$$

The angle of b can be chosen as the same as that of $\beta_i$.

In the above formulation, if we intend to only preserve the power in the reconstructed physical channel (e.g.: for the LFE channel), only $\alpha_i$, needs to be sent, and $\beta_i$, can be assumed to be zero. Similarly, in order to reduce the number of parameters being sent, only the magnitude of $\beta_i$, can be sent and the angle can be assumed to be zero.

The number of parameters 3716 to be sent to the decoder can be reduced by one, if the encoder scales the physical channels so as to impose the one of the following constraints on $\alpha_i$:

$$\Sigma\alpha_i^2=1$$

or $$\Pi\alpha_i^2=1$$

If the encoder scales the input so that either of the above conditions are met, then $\alpha_i$ for one of the physical channels need not be sent, and can be computed implicitly by the decoder. This scaling makes the coded channels preserve the power in the original physical channels in some sense.

At the decoder, the reconstruction 3750 is normally done using $W_i$, and its decorrelated version $W_i^{\perp}$, i.e., $$\hat{X}_i = aW_i + bW_i^{\perp}$$

$$\hat{X}_i = \alpha_i\beta_iW_i + \alpha_i\sqrt{1-|\beta_i|^2}W_i^{\perp}$$

In order to reduce cross-talk between channels, instead of decorrelating $W_i$, the reverb can be applied to the first component of $\hat{X}_i$ in the equation above, i.e., $$U_i = \alpha_i\beta_iW_i$$

$$\hat{X}_i = U_i + \lambda_i\frac{\sqrt{1 - |\beta_i|^2}}{|\beta_i|}U_i^{\perp}$$

where $\lambda_i$ is the scale factor used to adjust the power in the decorrelated signal to prevent post-echo, and the scale factor for the reverb channel has been adjusted assuming that the power in the reverb component $U_i^{\perp}$ is approximately equal to $\alpha_i^2|\beta_i|^2E[W_iW^*_i]$. In the case it is much larger, then $\lambda_i$ is used to scale it down. To do this, the decoder measures the power from the output of the decorrelated signal and then matches it with the expected power. If it is larger than some expected threshold T times the expected power ($E[U_i^{\perp}U_i^{\perp *}]>T\alpha_i^2|\beta_i|^2E[W_iW^*_i]$), the output from the reverb filter is further scaled down. This gives the following scale factor for $\lambda_i$.

$$\lambda_i = \min\left(\sqrt{\frac{T\alpha_i^2|\beta_i|^2 E[W_i W_i^*]}{E[U_i^{\perp} U_i^{\perp *}]}}, 1\right) = \min\left(\alpha_i|\beta_i|\sqrt{\frac{TE[W_i W_i^*]}{E[U_i^{\perp} U_i^{\perp *}]}}, 1\right)$$

Decoder complexity could potentially be reduced by not having the decoder compute the power at the output of the reverb filter and the virtual channel, and instead have the encoder compute the value of $\lambda_i$, and modify $\alpha_i$ and $\beta_i$ that are sent to the decoder to account for this. That is find parameters such that a=a' and b'=b$\lambda_i$. This gives the following modifications to the parameters.

$$\alpha_i' = \alpha_i\sqrt{\lambda_i^2 - \lambda_i^2|\beta_i|^2 + |\beta_i|^2}$$

$$\beta_i' = \frac{\beta_i}{\sqrt{\lambda_i^2 - \lambda_i^2|\beta_i|^2 + |\beta_i|^2}}$$

However, this approach has one potential issue. The values for these parameters preferably are not sent every frame, and instead are sent only once every N frames, from which the decoder interpolates these values for the intermediate frames. Interpolating the parameters gives fairly accurate values of the original parameters for every frame. However, interpolation of the modified parameters may not yield as good results since the scale factor adjustment is dependent upon the power of the decorrelated signal for a given frame.

Instead of sending the cross-correlation between the physical channel and the coded channel, one can also send the cross-correlation between physical channels if the physical channels are being reconstructed from the same $W_i$, for example, $$\alpha_i = \sqrt{\frac{E[X_i X_i^*]}{E[W_i W_i^*]}}$$

$$\alpha_j = \sqrt{\frac{E[X_j X_j^*]}{E[W_i W_i^*]}}$$

$$\gamma_{ij} = \frac{E[X_i X_j^*]}{\sqrt{E[X_i X_i^*]E[X_j X_j^*]}}$$

where $X_i$ and $X_j$ are two physical channels that contribute to the coded channel $Y_i$. In this case, the two physical channels can be reconstructed so as to maintain the cross-correlation between the physical channels, in the following manner:

$$\begin{bmatrix} \hat{X}_i \\ \hat{X}_j \end{bmatrix} = \begin{bmatrix} a & d \\ b & -d \end{bmatrix} \begin{bmatrix} W_i \\ W_i^{\perp} \end{bmatrix}$$

Solving for just the magnitudes, we get $$a^2+d^2=\alpha_i^2$$

$$b^2+d^2=\alpha_j^2$$

$$ab-d^2=|\delta_{ij}|,$$

where, $\delta_{ij}=\gamma_{ij}\alpha_i\alpha_j$. This gives, $$d = \sqrt{\frac{\alpha_i^2\alpha_j^2 - |\delta_{ij}|^2}{2|\delta_{ij}| + \alpha_i^2 + \alpha_j^2}}$$

$$a = \frac{\alpha_i^2 + |\delta_{ij}|}{\sqrt{2|\delta_{ij}| + \alpha_i^2 + \alpha_j^2}}$$

$$b = \frac{\alpha_j^2 + |\delta_{ij}|}{\sqrt{2|\delta_{ij}| + \alpha_i^2 + \alpha_j^2}}$$

The phase of the cross correlation can be maintained by setting the phase difference between the two rows of the transform matrix to be equal to angle of $\gamma_{ij}$.

In view of the many possible embodiments to which the principles of our invention may be applied, we claim as our invention all such embodiments as may come within the scope and spirit of the following claims and equivalents thereto.

We claim:

1. A method of reconstructing multi-channel audio from a compressed bitstream, the method comprising:

receiving the compressed bitstream, the compressed bitstream containing a plurality of coded channels and power correlation parameters, the number of coded channels being fewer than a number of physical channels of the multi-channel audio, the power correlation parameters characterizing a full power correlation matrix;

decoding a vector of coded audio channel coefficients and power correlation parameters from the received bitstream for a frequency band;

forming a virtual audio channel coefficients vector for the frequency band comprising the decoded vector of coded audio channel coefficients and coefficients of decorrelated versions of the coded audio channels;

determining the full power correlation matrix for the frequency band from the power correlation parameters;

constructing a linear transform for multi-channel audio reconstruction relating the virtual audio channel coefficients vector to a reconstructed multi-channel audio coefficients vector;

applying the linear transform to the virtual audio channel coefficients vector to produce the reconstructed multi-channel audio coefficients vector; and with a processing unit, applying an inverse time-frequency transform to the reconstructed multi-channel audio coefficients vector to reproduce the multi-channel audio.

2. The method of claim 1 wherein the act of constructing the linear transform for multi-channel audio reconstruction comprises:

calculating an inverse Karhunen-Loeve Transform of the virtual audio channel coefficients vector; and constructing the linear transform for multi-channel audio reconstruction based on the inverse Karhunen-Loeve Transform of the virtual audio channel coefficients vector and further based on the Karhunen-Loeve Transform obtained from the full power correlation matrix of the physical channels for the frequency band.

3. The method of claim 1 wherein the act of constructing the linear transform for multi-channel audio reconstruction comprises:

calculating a power correlation matrix of the virtual audio channel coefficients vector using a linear channel transform of the full power correlation matrix of the physical channels for the frequency band, the linear channel transform relating the coded channels to the physical channels of the multi-channel audio; and constructing the linear transform for multi-channel audio reconstruction from the power correlation matrix of the virtual audio channel coefficients.

4. The method of claim 1 wherein the power correlation parameters encode a non-coded channel components portion of a correlation matrix of a second channel coefficients vector related by a second linear channel transform to the physical channels of the multi-channel audio, and the method further comprises:

decoding the non-coded channel components portion of the correlation matrix of the second channel coefficients vector from the channel correlation parameters of the compressed bitstream;

combining the decoded portion of the correlation matrix of the second channel coefficients vector with a coded channel power correlation matrix to form the full power correlation matrix;

reconstructing the second channel coefficients vector from the coded audio channel coefficients vector;

performing an inverse of the second linear channel transform of the reconstructed second channel coefficients vector to produce the reconstructed multi-channel audio coefficients vector.

5. The method of claim 1 further comprising:

computing the coded channel power correlation matrix from the coded audio channels coefficients vector.

6. The method of claim 1 wherein the coded channel power correlation matrix is a spherical power correlation matrix and the channel correlation parameters specify a normalized version of the non-coded channel components portion of the correlation matrix of the second channel coefficients vector.

7. A method of reconstructing multi-channel audio from a compressed bitstream, the method comprising:

receiving the compressed bitstream, the compressed bitstream containing a plurality of coded channels and power correlation parameters, the number of coded channels being fewer than a number of physical channels of the multi-channel audio, the power correlation parameters characterizing at least a partial power correlation matrix;

decoding a vector of coded audio channel coefficients and power correlation parameters from the received bitstream for a frequency band;

producing a vector of coefficient of a plurality of virtual audio channels for the frequency band as a linear transform of the coded audio channel coefficients vector;

producing a decorrelated version of the virtual audio channel coefficients vector for the frequency band;

calculating weighting factors for preserving power of the physical channels and cross-correlation between the physical channels;

reconstructing a multi-channel audio coefficients vector for the frequency band as a sum of products of the weighting factors and the versions of the virtual audio channel coefficients vector; and with a processing unit, applying an inverse time-frequency transform to the reconstructed multi-channel audio coefficients vector to reproduce the multi-channel audio.

8. The method of claim 7 wherein the power correlation parameters relate to power of the physical channels and cross-correlation between the physical channels and the virtual audio channels and weighting factors are computed for preserving power of the physical channels and cross-correlation between the physical channels and the virtual audio channels.

9. The method of claim 8 wherein the power correlation parameters specify magnitude and not phase of the cross-correlation between the physical channels and the virtual audio channels.

10. The method of claim 7 wherein the power correlation parameters specify magnitude and not phase of the cross-correlation between the physical channels.

11. The method of claim 7 wherein the power correlation parameters comprise:

a first parameter corresponding to a square root of a ratio of a power of the physical channels to a power of the virtual audio channels; and a second parameter corresponding to a ratio of a cross-correlation between the physical channels and the virtual audio channels to a square root of a product of the power of the physical channels and the virtual audio channels.

12. The method of claim 7 wherein the power correlation parameters comprise:

a first parameter corresponding to a square root of a ratio of a power of the physical channels to a power of the virtual audio channels; and a second parameter corresponding to a magnitude of a ratio of a cross-correlation between the physical channels and the virtual audio channels to a square root of a product of the power of the physical channels and the virtual audio channels, and wherein an angle of said ratio is not contained in the power correlation parameters.

13. The method of claim 7 wherein the power correlation parameters relate to a cross-correlation between physical channels that contribute to each of the coded audio channels, and wherein the power correlation parameters comprise:

a first parameter corresponding to a square root of a ratio of a power of a first of two out of the physical channels that contribute to the respective virtual audio channels to the power of the respective virtual audio channels;

a second parameter corresponding to a square root of a ratio of a power of a second of the two out of the physical channels that contribute to the respective virtual audio channels to the power of the respective virtual audio channels; and a third parameter corresponding to a ratio of the cross-correlation between the two out of the physical channels to a square root of a product of the power of the two out of the physical channels.

14. A method of reproducing multi-channel audio from a compressed bitstream, the method comprising:

receiving the compressed bitstream, the compressed bitstream containing a plurality of coded channels and power correlation parameters, the number of coded channels being fewer than a number of physical channels of the multi-channel audio, the power correlation parameters characterizing at least a partial power correlation matrix;

decoding a vector of coded audio channel coefficients and power correlation parameters from the received bitstream for a frequency band;

producing a virtual audio channel coefficients vector corresponding to a plurality of virtual channels for the frequency band based on the coded audio channel coefficients vector;

deriving reconstruction parameters from the power correlation parameters that preserve at least partially a power cross-correlation matrix of the physical channels;

reconstructing a multi-channel audio coefficients vector for the frequency band as a function of the virtual audio channel coefficients and reconstruction parameters; and with a processing unit, applying an inverse time-frequency transform to the reconstructed multi-channel audio coefficients vector to reproduce the multi-channel audio.

15. The method of claim 14 wherein the power correlation parameters comprise a full power cross-correlation matrix of the physical channels.

16. The method of claim 14 wherein the power correlation parameters comprise a cross-correlation matrix for a non-coded channels part of the virtual channels and a cross-correlation matrix between the coded channels and the non-coded channels part of the virtual channels.

17. The method of claim 14 wherein the power correlation parameters comprise a normalized power cross-correlation matrix of at least a non-coded channels part of the virtual channels.

18. The method of claim 14 wherein the power correlation parameters relate to power of the physical channels and cross correlation between the physical channels and the coded channels.

19. The method of claim 18 wherein the power correlation parameters are modified based on a scale factor for adjusting power of the virtual channels to reduce a post-echo effect.

20. The method of claim 14 wherein the power correlation parameters relate to power of the physical channels and cross correlation between the physical channels that contribute to each of the coded channels.

* * * * *